US009895918B2

(12) United States Patent
Ito et al.

(10) Patent No.: US 9,895,918 B2
(45) Date of Patent: Feb. 20, 2018

(54) IMAGE FORMING APPARATUS, IMAGE FORMING SYSTEM, AND METHOD FOR FORMING TEST PATTERNS

(71) Applicant: BROTHER KOGYO KABUSHIKI KAISHA, Nagoya, Aichi (JP)

(72) Inventors: Tsuyoshi Ito, Aichi (JP); Kohei Terada, Kiyosu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/388,367

(22) Filed: Dec. 22, 2016

(65) Prior Publication Data

US 2017/0182824 A1 Jun. 29, 2017

(30) Foreign Application Priority Data

Dec. 28, 2015 (JP) ..... 2015-256859

(51) Int. Cl.

| | |
|---|---|
| ***B41J 29/393*** | (2006.01) |
| ***B41J 11/42*** | (2006.01) |
| ***B41J 29/38*** | (2006.01) |
| *B41J 2/01* | (2006.01) |

(52) U.S. Cl.

CPC ..... *B41J 29/393* (2013.01); *B41J 11/42* (2013.01); *B41J 29/38* (2013.01); *B41J 2/01* (2013.01)

(58) Field of Classification Search

CPC . B41J 29/393; B41J 29/38; B41J 11/42; B41J 2/01

See application file for complete search history.

(56) References Cited

U.S. PATENT DOCUMENTS

| | | | | |
|---|---|---|---|---|
| 8,678,537 | B2 * | 3/2014 | Suzuki | B41J 11/42 347/101 |
| 2007/0126838 | A1 * | 6/2007 | Tatsumi | B41J 11/42 347/104 |
| 2013/0257936 | A1 | 10/2013 | Terada | |
| 2013/0286079 | A1 | 10/2013 | Uchida | |

FOREIGN PATENT DOCUMENTS

| | | | |
|---|---|---|---|
| JP | 2013-212584 | A | 10/2013 |
| JP | 2013-226759 | A | 11/2013 |
| JP | 2014-226861 | A | 12/2014 |

* cited by examiner

*Primary Examiner* — Thinh H Nguyen

(74) *Attorney, Agent, or Firm* — Scully, Scott, Murphy & Presser, PC

(57) ABSTRACT

An image forming apparatus includes a controller configured to control a first image former to form a first test pattern on a recording medium, the first test pattern including figures arranged in a first direction on a two-dimensional lattice defined with an X-axis direction intersecting a Y-axis direction parallel to a conveyance direction, the first direction being inclined relative to the X-axis direction, control a conveyor to convey the recording medium in the conveyance direction, and in response to the recording medium being conveyed to a position where a second test pattern intersects or is in proximity to the first test pattern, control a second image former to form the second test pattern on the recording medium, the second test pattern including figures arranged in a second direction on the two-dimensional lattice, the second direction being inclined relative to each of the X-axis direction and the first direction.

19 Claims, 15 Drawing Sheets

IMAGE FORMING APPARATUS, IMAGE FORMING SYSTEM, AND METHOD FOR FORMING TEST PATTERNS

CROSS-REFERENCE TO RELATED APPLICATION

This application claims priority under 35 U.S.C. § 119 from Japanese Patent Application No. 2015-256859 filed on Dec. 28, 2015. The entire subject matter of the application is incorporated herein by reference.

BACKGROUND

Technical Field

The following description relates to aspects of an image forming apparatus, an image forming system, and a method for forming test patterns.

Related Art

Heretofore, as image forming apparatuses, serial printers such as inkjet printers and dot impact printers, and electrophotographic page printers such as laser printers and LED printers have been known.

Further, an image forming apparatus has been known that is configured to form test patterns on a sheet-shaped recording medium (e.g., a paper), in order to form a high-quality image by suppressing a conveyance distance error caused when the recording medium is conveyed. For instance, the image forming apparatus may be configured to form a first test pattern on a recording medium, then convey the recording medium over a predetermined distance, and thereafter form a second test pattern on the recording medium. In this case, a conveyance distance error caused by the conveyance of the recording medium may be determined based on a positional relationship between the first test pattern and the second test pattern.

SUMMARY

As methods for forming test patterns, for instance, the following first and second methods have been known. In the first method, after a first test pattern is formed on a recording medium, conveying the recording medium over a very short distance and forming a second test pattern on the recording medium are repeatedly performed. A conveyance distance error is determined based on a positional relationship (e.g., an overlap) between the first test pattern and the second test pattern formed each time the recording medium has been conveyed over the very short distance.

In the second method, a first test pattern along a main scanning direction is formed on a recording medium with upstream nozzles, which are positioned upstream of the other nozzles of a recording head (e.g., an inkjet head) in a conveyance direction of the recording medium. Then, after the recording medium is conveyed over a predetermined distance, a second test pattern inclined relative to the main scanning direction is formed on the recording medium with downstream nozzles, which are positioned downstream of the other nozzles of the recording head in the conveyance direction. For instance, the first test pattern may include a plurality of dot rows (e.g., pixel rows) each of which is formed parallel to the main scanning direction and arranged on a straight line parallel to the main scanning direction. The second test pattern may include a plurality of dot rows each of which is formed parallel to the main scanning direction and arranged on a straight line inclined relative to the main scanning direction. A conveyance distance error may be determined based on a positional relationship (e.g., an overlap) between the first test pattern and the second test pattern.

According to the first method, the second test pattern is formed by repeating the conveyance of the recording medium over the very short distance. Therefore, it takes a long period of time to complete all the procedure for forming the test patterns. Meanwhile, according to the second method, it is not possible to adjust the position of each second test pattern on the basis of a distance less than a dot pitch in a sub scanning direction (i.e., the conveyance direction of the recording medium). Thus, it is difficult to evaluate a conveyance distance error less than the dot pitch.

Aspects of the present disclosure are advantageous to provide one or more improved techniques for efficiently forming test patterns to accurately determine a conveyance distance error.

According to aspects of the present disclosure, an image forming apparatus is provided that includes a conveyor configured to convey a recording medium in a conveyance direction, a first image former configured to form an image on the recording medium by selectively placing pixels on lattice points of a two-dimensional lattice, the two-dimensional lattice including a plurality of lattice points arranged at intervals of a predetermined pitch in each of an X-axis direction and a Y-axis direction, the Y-axis direction being parallel to the conveyance direction, the X-axis direction intersecting the Y-axis direction, a second image former disposed downstream of the first image former in the conveyance direction, the second image former being configured to form an image on the recording medium by selectively placing pixels on lattice points of the two-dimensional lattice, and a controller configured to perform a first formation control process including controlling the first image former to form a first test pattern on the recording medium, the first test pattern including a plurality of figures arranged on a first virtual straight line extending in a first direction, the first direction being inclined relative to the X-axis direction and directed from a first arbitrary lattice point toward a first specific lattice point on the two-dimensional lattice, the first specific lattice point being an A1-th lattice point from the first arbitrary lattice point as a zeroth lattice point in the X-axis direction and a B1-th lattice point from the first arbitrary lattice point as a zeroth lattice point in the Y-axis direction, B1 being a value smaller than A1, perform a conveyance control process including controlling the conveyor to convey the recording medium downstream in the conveyance direction, and perform a second formation control process including in response to the recording medium being conveyed to a position where a second test pattern to be formed is allowed to intersect or be in proximity to the first test pattern formed on the recording medium, controlling the second image former to form the second test pattern on the recording medium, the second test pattern including a plurality of figures arranged on a second virtual straight line extending in a second direction, the second direction being inclined relative to each of the X-axis direction and the first direction and directed from a second arbitrary lattice point toward a second specific lattice point on the two-dimensional lattice, the second specific lattice point being an A2-th lattice point from the second arbitrary lattice point as a zeroth lattice point in the X-axis direction and a B2-th lattice point from the second arbitrary lattice point as a zeroth lattice point in the Y-axis direction, B2 being a value smaller than A2.

A conveyance distance error of the recording medium may be determined based on a positional displacement of an intersection between the first test pattern and the second test pattern from a reference point. The intersection may be interpreted in a broad sense. For instance, the intersection may include a point where the first test pattern and the second test pattern would intersect each other if the first test pattern were extended in the first direction, and the second test pattern were extended in the second direction.

As an angle between the first test pattern and the second test pattern is made smaller, the positional displacement of the intersection therebetween in the X-axis direction (i.e., the main scanning direction) becomes larger with respect to the same conveyance distance error in the Y-axis direction (i.e., the conveyance direction). However, a known image forming apparatus forms a first test pattern including a plurality of first dot rows each of which is formed parallel to the X-axis direction and arranged in the X-axis direction. Further, the known image forming apparatus forms a second test pattern including a plurality of second dot rows each of which is formed parallel to the X-axis direction and arranged in a particular direction of a vector (X, Y)=(A2, B2), where B2 is not equal to zero. The particular direction is inclined relative to the X-axis direction. Each first dot row, which includes a plurality of dots arranged in the X-axis direction, may be an example of the "first elemental figure" according to aspects of the present disclosure. Each second dot row, which includes a plurality of dots arranged in the X-axis direction, may be an example of the "second elemental figure" according to aspects of the present disclosure. The vector (X, Y) is directed from an arbitrary lattice point toward a specific lattice point on the two-dimensional lattice. The specific lattice point is an X-th lattice point from the arbitrary lattice point as a zeroth lattice point in the X-axis direction and is a Y-th lattice point from the arbitrary lattice point as a zeroth lattice point in the Y-axis direction.

When the first test pattern is formed in the above manner by the known image forming apparatus, the angle between the first test pattern and the second test pattern corresponds to an angle between the X-axis direction and the vector (X, Y)=(A2, B2). The angle is made smaller by setting an absolute value of B2 smaller and setting an absolute value of A2 larger. It is noted that a lower limit of the absolute value of B2 is one. The absolute value of B2 equal to one corresponds to a pixel pitch in the conveyance direction of the recording medium. Namely, according to the known image forming apparatus, due to an influence of the pixel pitch (i.e., a resolution) in the conveyance direction of the recording medium, it is impossible to set the angle between the first test pattern and the second test pattern to a desirably small angle. Thus, it is difficult to determine a minute conveyance distance error caused by conveyance of the recording medium.

According to aspects of the present disclosure, the first and second test patterns inclined relative to the X-axis direction are formed on the recording medium. Thus, when both of the first test pattern and the second test pattern are inclined relative to the X-axis direction, it is possible to set smaller the angle between the first test pattern and the second test pattern in comparison with the known image forming apparatus that forms one of the first and second test patterns to be parallel to the X-axis direction.

Thus, according to aspects of the present disclosure, it is possible to form test patterns for accurately determining the conveyance distance error caused by conveyance of the recording medium. Further, it is possible to efficiently form test patterns for accurately determining the conveyance distance error of the recording medium without repeating an operation of conveying the recording medium over a very short distance as performed by a known image forming apparatus.

According to aspect of the present disclosure, the first test pattern and the second test pattern may be formed as geometrical patterns each of which includes a plurality of pixels (e.g., dots) arranged in a terraced shape to be macroscopically or approximately a straight line inclined relative to the other. Further, the first test pattern and the second test pattern may be formed as geometrical patterns each of which includes a plurality of pixels (e.g., dots) arranged to be macroscopically or approximately a straight line with a uniform width.

According to aspects of the present disclosure, further provided is an image forming system that includes a printer configured to form a first test pattern and a second test pattern on a recording medium, a scanner configured to scan the recording medium with the first test pattern and the second test pattern formed thereon, and generate image data expressing a scanned image of the recording medium, and a controller coupled with the printer and the scanner. The printer includes a conveyor configured to convey the recording medium in a conveyance direction, a first image former configured to form an image on the recording medium by selectively placing pixels on lattice points of a two-dimensional lattice, the two-dimensional lattice including a plurality of lattice points arranged at intervals of a predetermined pitch in each of an X-axis direction and a Y-axis direction, the Y-axis direction being parallel to the conveyance direction, the X-axis direction intersecting the Y-axis direction, and a second image former disposed downstream of the first image former in the conveyance direction, the second image former being configured to form an image on the recording medium by selectively placing pixels on lattice points of the two-dimensional lattice. The controller is configured to perform a first formation control process including controlling the first image former to form the first test pattern on the recording medium, the first test pattern including a plurality of figures arranged on a first virtual straight line extending in a first direction, the first direction being inclined relative to the X-axis direction and directed from a first arbitrary lattice point toward a first specific lattice point on the two-dimensional lattice, the first specific lattice point being an A1-th lattice point from the first arbitrary lattice point as a zeroth lattice point in the X-axis direction and a B1-th lattice point from the first arbitrary lattice point as a zeroth lattice point in the Y-axis direction, B1 being a value smaller than A1, perform a conveyance control process including controlling the conveyor to convey the recording medium downstream in the conveyance direction, perform a second formation control process including in response to the recording medium being conveyed to a position where the second test pattern to be formed is allowed to intersect or be in proximity to the first test pattern formed on the recording medium, controlling the second image former to form the second test pattern on the recording medium, the second test pattern including a plurality of figures arranged on a second virtual straight line extending in a second direction, the second direction being inclined relative to each of the X-axis direction and the first direction and directed from a second arbitrary lattice point toward a second specific lattice point on the two-dimensional lattice, the second specific lattice point being an A2-th lattice point from the second arbitrary lattice point as a zeroth lattice point in the X-axis direction and a B2-th lattice point from the second arbitrary lattice point as a zeroth lattice point in the Y-axis direction, B2 being a value smaller than A2, perform a scanning control process including controlling the scanner to scan the recording medium with the first test pattern and the second test pattern formed thereon and to generate image data expressing a scanned image of the recording medium, and perform an error determining process including identifying a position of an intersection between the first test pattern and the second test pattern formed on the recording medium by analyzing the image data generated by the scanner, and determining a conveyance distance error caused by conveyance of the recording medium based on the identified position of the intersection between the first test pattern and the second test pattern.

According to aspects of the present disclosure, further provided is a method implementable on a processor coupled with an image forming apparatus including a conveyor configured to convey a recording medium in a conveyance direction, a first image former configured to form an image on the recording medium by selectively placing pixels on lattice points of a two-dimensional lattice, the two-dimensional lattice including a plurality of lattice points arranged at intervals of a predetermined pitch in each of an X-axis direction and a Y-axis direction, the Y-axis direction being parallel to the conveyance direction, the X-axis direction intersecting the Y-axis direction, and a second image former disposed downstream of the first image former in the conveyance direction, the second image former being configured to form an image on the recording medium by selectively placing pixels on lattice points of the two-dimensional lattice, the method including performing a first formation control process including controlling the first image former to form a first test pattern on the recording medium, the first test pattern including a plurality of figures arranged on a first virtual straight line extending in a first direction, the first direction being inclined relative to the X-axis direction and directed from a first arbitrary lattice point toward a first specific lattice point on the two-dimensional lattice, the first specific lattice point being an A1-th lattice point from the first arbitrary lattice point as a zeroth lattice point in the X-axis direction and a B1-th lattice point from the first arbitrary lattice point as a zeroth lattice point in the Y-axis direction, and B1 is a value smaller than A1, performing a conveyance control process including controlling the conveyor to convey the recording medium downstream in the conveyance direction, and performing a second formation control process including in response to the recording medium being conveyed to a position where a second test pattern is allowed to intersect or be in proximity to the first test pattern formed on the recording medium, controlling the second image former to form the second test pattern on the recording medium, the second test pattern including a plurality of figures arranged on a second virtual straight line extending in a second direction, the second direction being inclined relative to each of the X-axis direction and the first direction and directed from a second arbitrary lattice point toward a second specific lattice point on the two-dimensional lattice, the second specific lattice point is an A2-th lattice point from the second arbitrary lattice point as a zeroth lattice point in the X-axis direction and a B2-th lattice point from the second arbitrary lattice point as a zeroth lattice point in the Y-axis direction, B2 being a value smaller than A2.

BRIEF DESCRIPTION OF THE ACCOMPANYING DRAWINGS

FIG. 1 is a block diagram schematically showing a configuration of a multi-function peripheral (hereinafter referred to as an "MFP") in an illustrative embodiment according to one or more aspects of the present disclosure.

FIG. 2 schematically shows a partial configuration, around a recording head, of a sheet conveyor of the MFP in the illustrative embodiment according to one or more aspects of the present disclosure.

FIG. 3 is a flowchart showing a procedure of a test printing process to be executed by a controller of the MFP in the illustrative embodiment according to one or more aspects of the present disclosure.

FIGS. 4A, 4B, 4C, and 4D show a process in which test patterns are printed on a step-by-step basis in the illustrative embodiment according to one or more aspects of the present disclosure.

FIGS. 11A, 11B, 11C, 11D, and 11E shows test patterns in modifications according to one or more aspects of the present disclosure.

Figure 12:
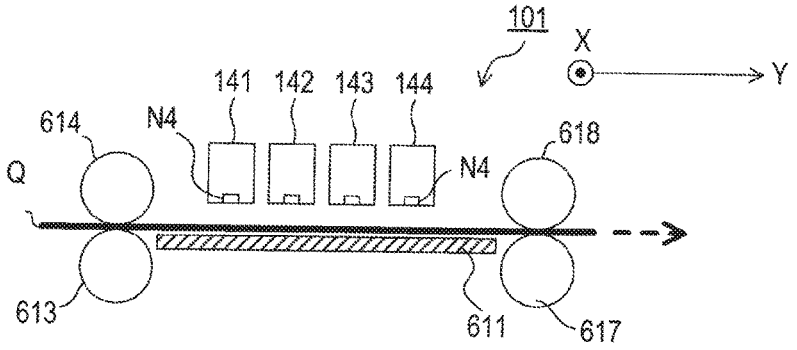

FIG. 12 schematically shows a configuration of a line inkjet printer in a modification according to one or more aspects of the present disclosure.

Figure 13:
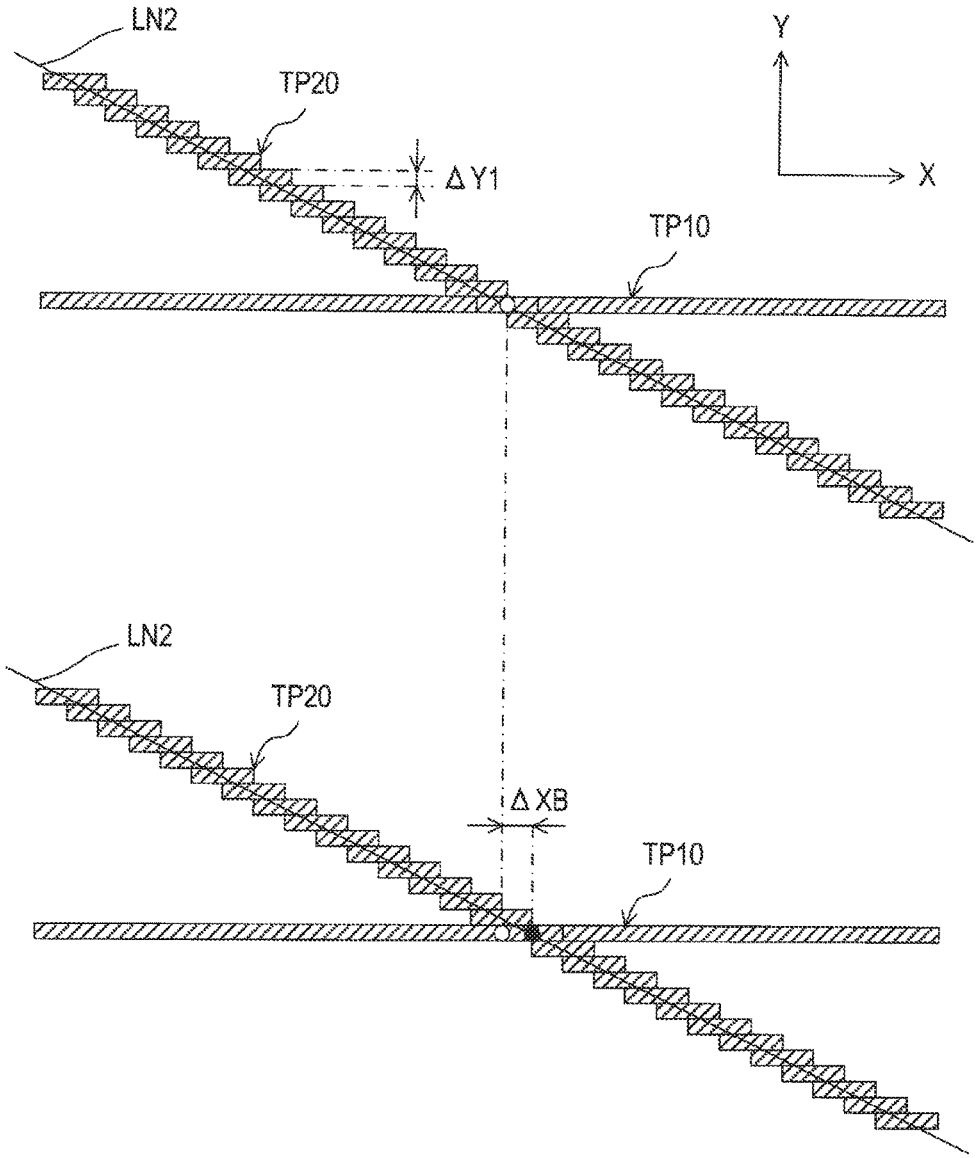
FIG. 13 PRIOR ART

FIG. 13 is an illustration for showing a positional displacement of an intersection between first and second test patterns from a reference point in a known method.

Figure 14:
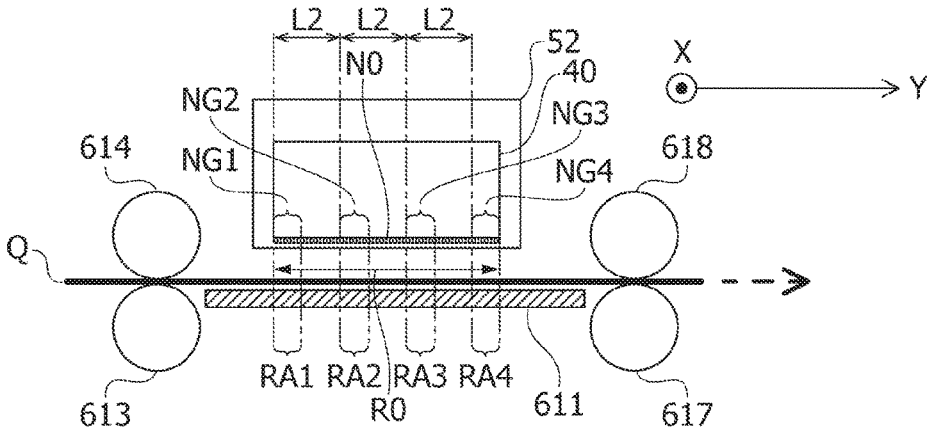

FIG. 14 schematically shows a partial configuration, around a recording head, of a sheet conveyor of an MFP in a further modification according to one or more aspects of the present disclosure.

Figure 15A:
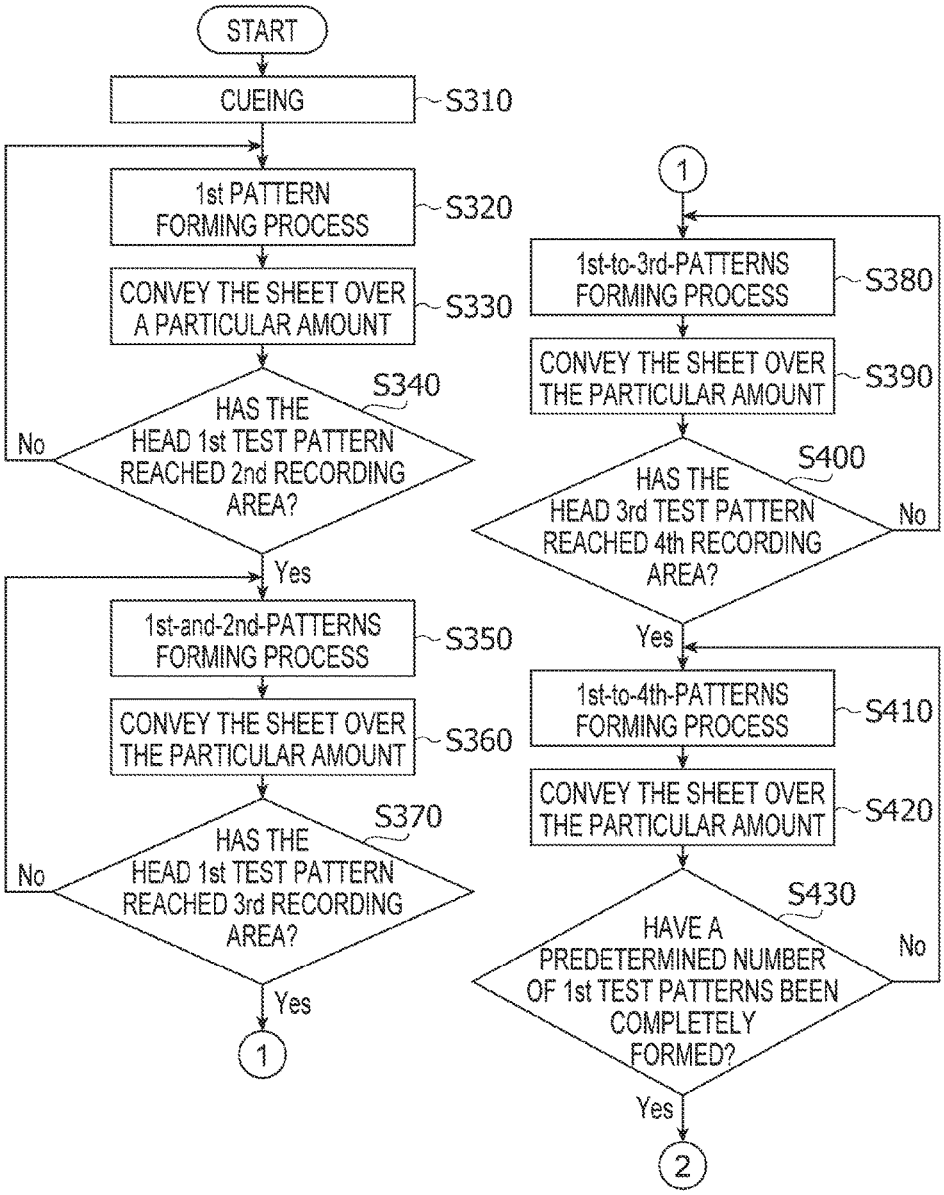
Figure 15B:
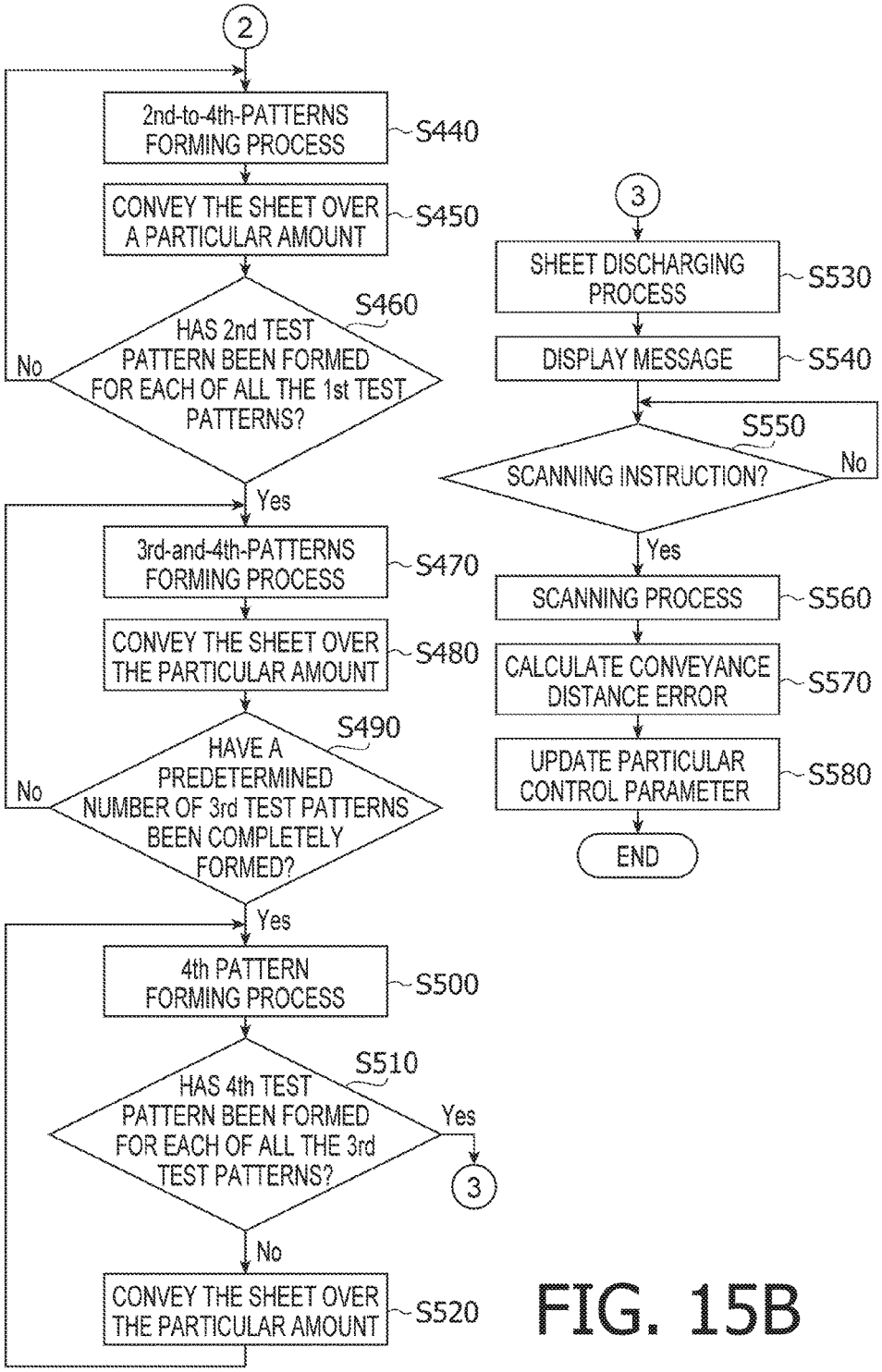

FIGS. 15A and 15B are flowcharts showing a procedure of a test printing process to be executed by a controller of the MFP in the further modification according to one or more aspects of the present disclosure.

FIGS. 16A, 16B, 16C, and 16D show a process in which test patterns are printed on a step-by-step basis in the further modification according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

(Illustrative Embodiment)

Figure 1:
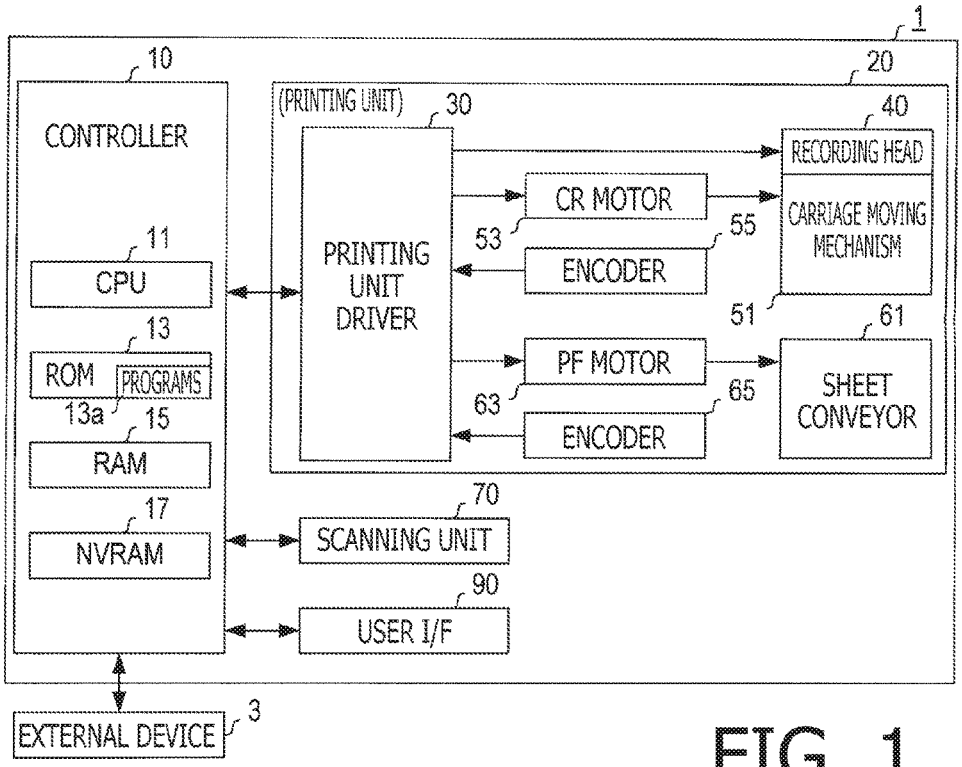

Hereinafter, an illustrative embodiment according to aspects of the present disclosure will be described with reference to the accompanying drawings. As shown in FIG. 1, a digital multi-function peripheral (hereinafter, simply referred to as an "MFP") 1 of the illustrative embodiment includes a controller 10, a printing unit 20, a scanning unit 70, and a user interface 90. The controller 10 is configured to take overall control of the MFP 1 and perform processes for causing the MFP 1 to serve as a printer, an image scanner, and a copy machine. The controller 10 includes a CPU 11, a ROM 13, a RAM 15, and an NVRAM 17.

The CPU 11 is configured to perform processes in accordance with computer programs 13*a* stored in the ROM 13. The RAM 15 is used as a work area when the CPU 11 is executing a computer program 13*a*. The NVRAM 17 is a non-volatile memory configured to electrically rewrite data stored therein. For instance, the NVRAM 17 may include a flash memory and/or an EEPROM. The controller 10 further includes a communication interface (not shown) configured to communicate with an external device 3 (e.g., a personal computer).

The printing unit 20 is configured as an inkjet printer. Specifically, the printing unit 20 is configured to, when controlled by the controller 10, form an image on a sheet Q. For instance, the printing unit 20 forms on a sheet Q an image based on data received from the external device 3 or image data expressing an image read by the scanning unit 70. Further, the printing unit 20 is configured to, when controlled by the controller 10, form on a sheet Q test patterns for determining a conveyance distance error caused when the sheet Q is conveyed.

The scanning unit 70 is configured as a flatbed scanner. Specifically, the scanning unit 70 is configured to, when controlled by the controller 10, optically scan a document placed on a document table and transmit to the controller 10 image data expressing a scanned image of the document. The user interface 90 includes a display configured to display various kinds of information for users, and an input device configured to accept instructions from users. The input device may include mechanical key switches and/or a touch panel on the display.

Subsequently, the printing unit 20 will be described in detail. As shown in FIG. 1, the printing unit 20 includes a printing unit driver 30, a recording head 40, a carriage moving mechanism 51, a CR motor 53, a linear encoder 55, a sheet conveyor 61, a PF motor 63, and a rotary encoder 65.

The printing unit driver 30 is configured to control the recording head 40 to discharge ink droplets, control the carriage moving mechanism 51 to move a carriage 52 (see FIG. 2), and control the sheet conveyor 61 to convey a sheet Q, in accordance with instructions from the controller 10. The printing unit driver 30 may include an ASIC.

Figure 2:
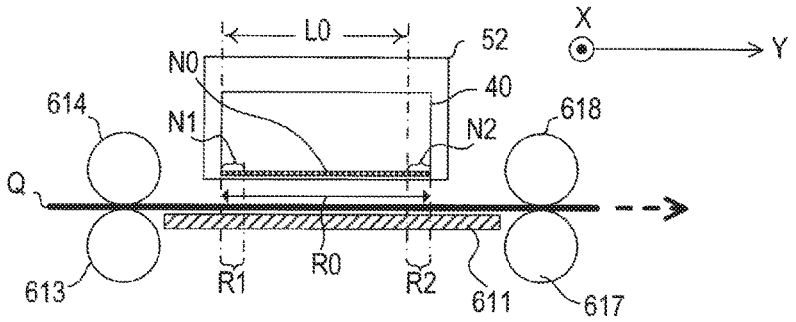

The recording head 40 is a known inkjet head. The recording head 40 is configured to, when controlled by the printing unit driver 30, discharge ink droplets thereby forming an image on a sheet Q. The recording head 40 has a lower surface facing the sheet Q, and includes ink discharge nozzles disposed at the lower surface. Specifically, the recording head 40 includes a group N0 of ink discharge nozzles arranged in a sub scanning direction. The sub scanning direction corresponds to a sheet conveyance direction. A main scanning direction is perpendicular to the sub scanning direction. The main scanning direction corresponds to a carriage moving direction (i.e., a normal direction of a flat surface on which FIG. 2 is drawn). Hereinafter, the group N0 of ink discharge nozzles may be referred to as a "nozzle group N0."

The carriage moving mechanism 51 includes the carriage 52 carrying the recording head 40. The carriage moving mechanism 51 is configured to move the carriage 52 along the main scanning direction (i.e., the normal direction of the flat surface on which FIG. 2 is drawn). The CR motor 53 includes a direct-current motor for driving the carriage moving mechanism 51. The CR motor 53 is controlled by the printing unit driver 30. Namely, the printing unit driver 30 controls rotation of the CR motor 53 thereby implementing control for moving the carriage 52.

The linear encoder 55 is configured to input pulse signals, which correspond to displacement of the carriage 52 in the main scanning direction, as encoder signals into the printing unit driver 30. The printing unit driver 30 detects a position and a velocity of the carriage 52 in the main scanning direction based on the encoder signals from the linear encoder 55, and performs feedback control of the position and the velocity of the carriage 52. The printing unit driver 30 controls the recording head 40 in accordance with the movement of the carriage 52, and causes the recording head 40 to intermittently discharge ink droplets while moving relative to the sheet Q in the main scanning direction. Thereby, an intended image is formed on the sheet Q.

The sheet conveyor 61 is configured to convey a sheet Q from a feed tray (not shown) to a discharge tray (not shown) via a recording area R0 in which image formation is performed by the recording head 40. FIG. 2 schematically shows a partial configuration, around the recording head 40, of the sheet conveyor 61. As shown in FIG. 2, the sheet conveyor 61 includes a platen 611 below the recording head 40. Further, the sheet conveyor 61 includes a conveyance roller 613, a pinch roller 614, a discharge roller 617, and a spur roller 618. The conveyance roller 613 and the pinch roller 614 are disposed to face each other in a position upstream of the platen 611 in the sheet conveyance direction. The discharge roller 617 and the spur roller 618 are disposed to face each other in a position downstream of the platen 611 in the sheet conveyance direction.

The conveyance roller 613 and the discharge roller 617 are connected with the PF motor via a transmission mechanism (not shown). In response to receiving a driving force from the PF motor 63, the conveyance roller 613 and the discharge roller 617 rotate in synchronization with each other. The PF motor 63 includes a direct-current motor for driving the sheet conveyor 61.

When a pickup roller (not shown) rotates, the sheet conveyor 61 separates sheets Q placed on the feed tray (not shown) on a sheet-by-sheet basis, and sequentially feeds the separated sheets Q between the conveyance roller 613 and the pinch roller 614. When driven to rotate by the PF motor 63, the conveyance roller 613 conveys a sheet Q fed from the feed tray downstream in the sheet conveyance direction indicated by a dashed arrow in FIG. 2. While pinching the sheet Q with the pinch roller 614, the conveyance roller 613 conveys, by the rotation thereof, the sheet Q downstream in the sheet conveyance direction.

The sheet Q, which is being conveyed downstream in the sheet conveyance direction by the rotation of the conveyance roller 613, passes over the recording area R0 below the recording head 40 while being supported by the platen 611. Then, the sheet Q is conveyed downstream in the sheet conveyance direction by the rotation of the discharge roller 617 while being pinched between the discharge roller 617 and the spur roller 618. After passing between the discharge roller 617 and the spur roller 618, the sheet Q is finally discharged onto the discharge tray (not shown).

The rotary encoder 65 may be disposed at a rotational shaft of the conveyance roller 613 or a rotational shaft of the PF motor 63, or may be disposed on a power transmission path from the PF motor 63 to the conveyance roller 613. The rotary encoder 65 is configured to input pulse signals, which correspond to rotation of the conveyance roller 613, as encoder signals into the printing unit driver 30.

Based on the encoder signals from the rotary encoder 65, the printing unit driver 30 detects a rotational quantity, a rotational speed, and a rotational phase $\varphi$ of the conveyance roller 613. The rotational phase $\varphi$ corresponds to a rotational angle $\varphi$ ($0 \leq \varphi < 2\pi$) of the conveyance roller 613 within a range from zero to $2\pi$ when a single rotation of the conveyance roller 613 is expressed as $2\pi$.

The controller 10 stores in the NVRAM 17 control parameters set according to an individual difference of the printing unit 20. The controller 10 appropriately controls the printing unit 20 based on the control parameters. Specifically, based on the control parameters stored in the NVRAM 17, the controller 10 sets for the printing unit driver 30 specific parameters that regulate operations of the printing unit driver 30, and controls the printing unit driver 30 to operate in accordance with the specific parameters. Thus, the controller 10 adapts the operations of the printing unit driver 30 to the individual difference of the printing unit 20, and thereby appropriately controls the printing unit 20.

Based on the encoder signals from the linear encoder 55 and the rotary encoder 65, the printing unit driver 30 takes control of the CR motor 53 and the PF motor 63 according to parameters set specifically for the CR motor 53 and the PF motor 63 by the controller 10. In the illustrative embodiment, the controller 10 and the printing unit driver 30 cooperate with each other. Thereby, it is possible to implement ink discharge control for the recording head 40 to discharge ink droplets, carriage moving control for the carriage moving mechanism 51 to move the carriage 52 carrying the recording head 40, and sheet conveyance control for the sheet conveyor 61 to convey the sheets Q.

Specifically, the control parameters stored in the NVRAM 17 include a particular control parameter that represents an association between the rotational quantity of the conveyance roller 613 and a sheet conveyance distance. Based on the particular control parameter, the controller 10 sets for the printing unit driver 30 the specific parameters that are adjusted to suppress control errors (e.g., a conveyance distance error caused when a sheet Q is conveyed) caused by the individual difference of the printing unit 20. For instance, the controller 10 calculates a target rotational quantity of the conveyance roller 613 corresponding to a target sheet conveyance distance, and sets for the printing unit driver 30 a parameter that represents the calculated target rotational quantity of the conveyance roller 613. Thereby, the conveyance roller 613 is controlled to convey the sheets Q in such a manner as to suppress a conveyance distance error caused by an eccentricity and/or an individual difference in shape of the conveyance roller 613.

The controller 10 corrects the particular control parameter that represents the association between the rotational quantity of the conveyance roller 613 and the sheet conveyance distance based on a result of test pattern formation. The particular control parameter is initially set to a standard value that is determined without considering the individual difference, and is updated to a value according to the individual difference, based on the result of test pattern formation.

Figure 3:
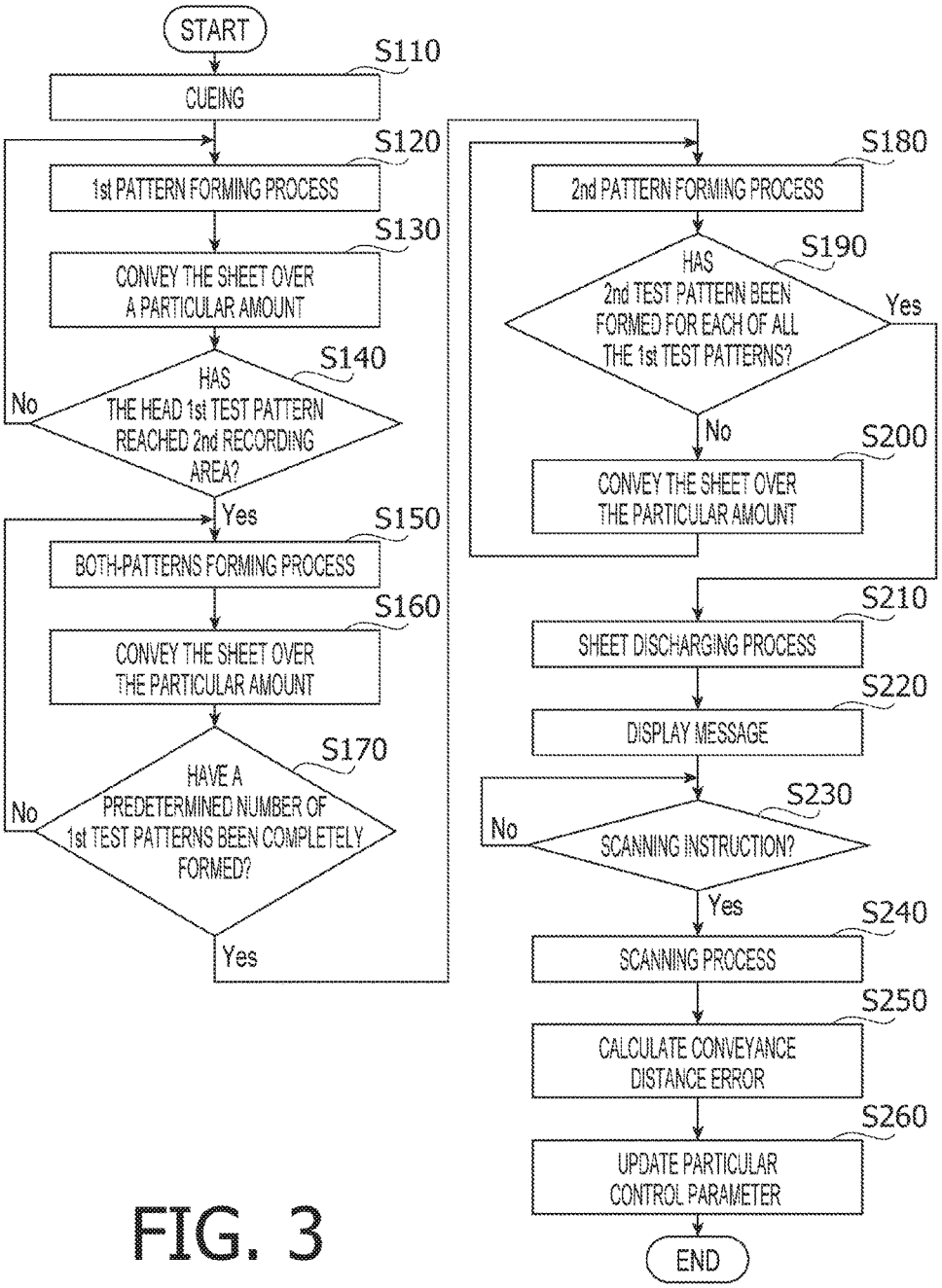

When receiving an instruction to print test patterns via the user interface 90 or from the external device 3, the controller 10 performs a test printing process shown in FIG. 3 in accordance with one or more programs 13*a* stored in the ROM 13. For instance, when a user of the MFP 1 or an operator of a manufacturer of the MFP 1 operates the user interface 90 or the external device 3, the instruction to print test patterns is issued.

When the test printing process is started, the controller 10 activates and controls the printing unit driver 30 to, while controlling the PF motor 63, cause the sheet conveyor 61 to convey a sheet Q to an upstream end section of the recording area R0 below the recording head 40 in the sheet conveyance direction (S110: Cueing).

Afterward, the controller 10 performs a first pattern forming process (S120). In the first pattern forming process, the controller 10 controls, via the printing unit driver 30, the recording head 40 to form a first test pattern TP11 on a portion of the sheet Q that is positioned in a first recording area R1, using a first nozzle group N1 (S120). The first recording area R1 corresponds to a partial area of the recording area R0 that is positioned under the first nozzle group N1. In other words, the first recording area R1 is an area of the recording area R0 where the recording head 40 is allowed to perform image formation using the first nozzle group N1. The first nozzle group N1 corresponds to a group of nozzles included in the nozzle group N0 that are positioned upstream of the other nozzles included in the nozzle group N0 in the sheet conveyance direction.

Figures 4A, 4B, 4C, 4D:
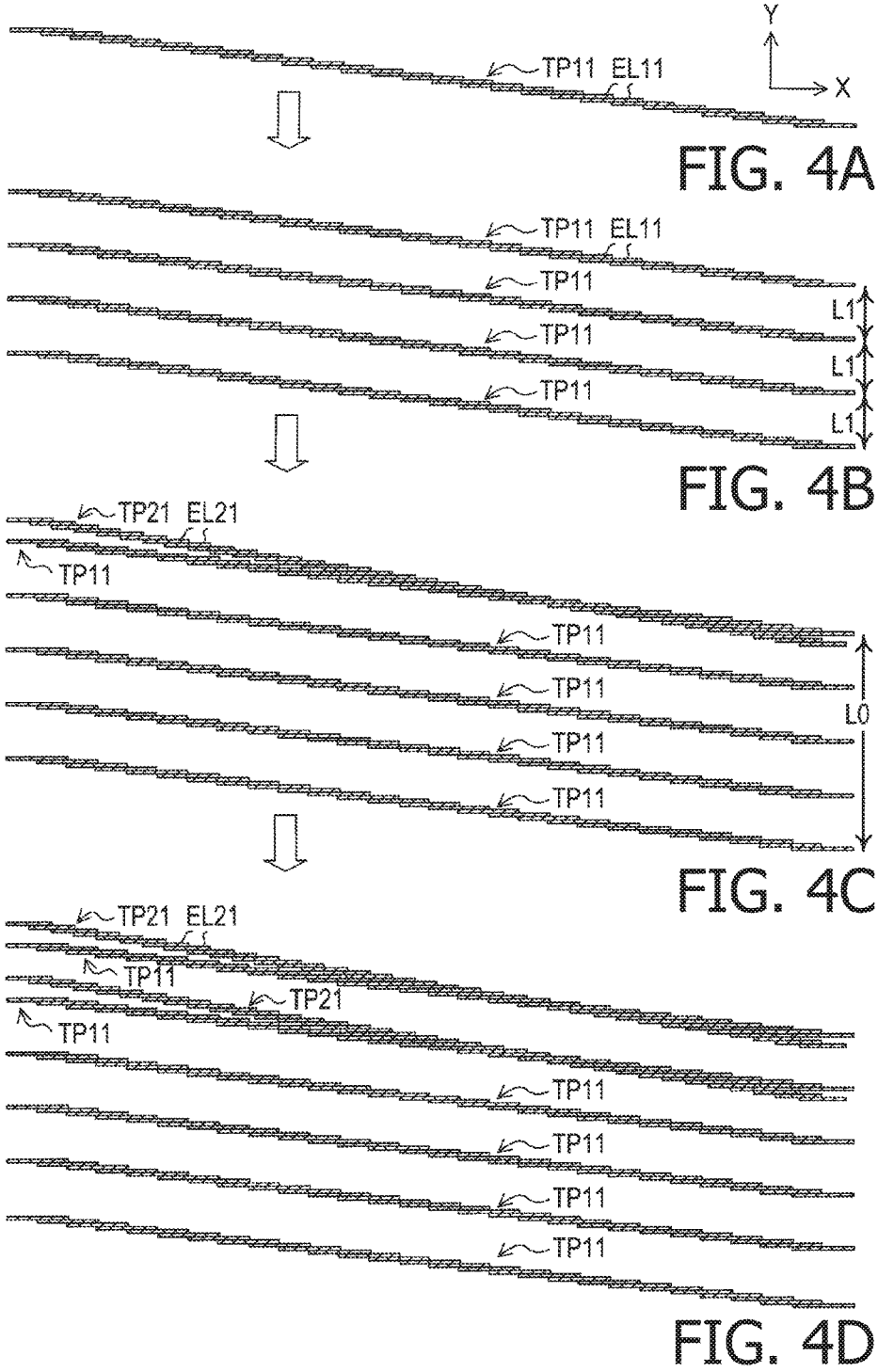

The first test pattern TP11 formed on the sheet Q has a geometrical pattern as exemplified in FIG. 4A. Specifically, the first test pattern TP11 is macroscopically or approximately a straight line that is slightly inclined relative to the main scanning direction. In the following description, for the sake of convenience in explaining the positions and the forms of test patterns, an X-Y rectangular coordinate system will be defined on a sheet surface.

The defined X-Y rectangular coordinate system has an X-axis along the main scanning direction and a Y-axis along the sheet conveyance direction (i.e., the sub scanning direction). The positive directions of the X-axis and the Y-axis may be arbitrarily defined. In the present example, the positive direction of the Y-axis is defined as a downstream direction along the sheet conveyance direction. Further, the positive direction of the X-axis is defined as a rightward direction with respect to the positive direction of the Y-axis.

Further, in the illustrative embodiment, a length or a distance in the Y-axis direction is defined on the basis of pixels. In other words, a unit length of the Y-axis is expressed with an interval (i.e., a pixel pitch) between adjacent two of pixels formable on the sheet Q in the sub scanning direction. Hereinafter, the pixel pitch may be referred to as a "dot pitch." The dot pitch corresponds to a nozzle interval of the recording head 40 in the sub scanning direction. When a distance (Y2-Y1) between a position Y1 and a position Y2 in the Y-axis direction is expressed as the value "3," it denotes that the position Y2 is three pixels away from the position Y1 in the sub scanning direction. In other words, it represents that there exists a space of two pixels between a pixel in the position Y1 and a pixel in the position Y2.

Further, in the illustrative embodiment, a length or a distance in the X-axis direction is defined on the basis of pixels. In other words, a unit length of the X-axis is expressed with an interval (i.e., a dot pitch) between adjacent two of the pixels formable on the sheet Q in the main scanning direction. When a distance (X2-X1) between a position X1 and a position X2 in the X-axis direction is expressed as the value "2," it denotes that the position X2 is two pixels away from the position X1 in the main scanning direction. In other words, it represents that there exists a space of one pixel between a pixel in the position X1 and a pixel in the position X2.

An image formed on the sheet Q is configured with a plurality of pixels (dots) selectively placed on a plurality of points (X, Y) each of which is defined by a combination of arbitrary integer values in the X-Y rectangular coordinate system. In the X-Y rectangular coordinate system, a point (X, Y) defined by a combination of arbitrary integer values may be regarded as a lattice point. Namely, the image formed on the sheet Q is configured with a plurality of pixels selectively placed on a plurality of lattice points of a two-dimensional lattice that are two-dimensionally arranged at intervals of a constant pitch in each of the X-axis direction and the Y-axis direction. In the following description, a vector (X, Y) may be understood as a vector directed from a start pixel to an end pixel that is away from the start pixel by X pixels in the X-axis direction and Y pixels in the Y-axis direction. In other words, the vector (X, Y) may be understood as a vector directed from an arbitrary lattice point to a specific lattice point in the aforementioned two-dimensional lattice. It is noted that, when the arbitrary lattice point is defined as the zeroth lattice point in both of the X-axis direction and the Y-axis direction, the specific lattice point is the X-th lattice point in the X-axis direction and the Y-th lattice point in the Y-axis direction.

In a general inkjet printer, the resolution in the main scanning direction is higher than the resolution in the sub scanning direction. For instance, an inkjet printer has been known that has a resolution of 600 dpi in the main scanning direction and a resolution of 300 dpi in the sub scanning direction. In the illustrative embodiment, the MFP 1 has a resolution in the main scanning direction that is higher than a resolution in the sub scanning direction. Namely, a dot pitch DP1 in the main scanning direction is shorter than a dot pitch DP2 in the sub scanning direction. This denotes that a degree of freedom for test pattern formation in the X-axis direction is higher than a degree of freedom therefor in the Y-axis direction.

Hereinafter, a detailed explanation will be provided of a disposition and a shape of the first test pattern TP11. The first test pattern TP11 formed on the sheet Q in S120 is a test pattern in which a rectangular elemental figure EL11 as a constituent of the test pattern is repeatedly formed to be arranged on a virtual straight line LN1. The virtual straight line LN1 is inclined relative to the main scanning direction. Specifically, each elemental figure EL11 includes a plurality of dots DT arranged linearly or in a rectangular shape as shown in FIG. 5.

Figure 5:
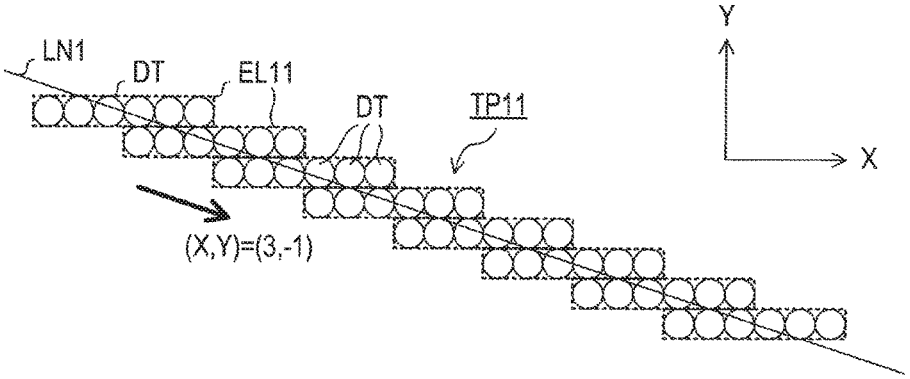
FIG. 5 is an enlarged view of a first test pattern in the illustrative embodiment according to one or more aspects of the present disclosure.

In an example shown in FIG. 5, the first test pattern TP11 is a geometrical pattern in which a plurality of uniform elemental figures EL11 are arranged in a direction of a first vector (X, Y)=(3, −1) along the virtual straight line LN1. Each uniform elemental figure EL11 includes six dots DT arranged linearly in the X-axis direction. It is noted that the virtual straight line LN1 is only used for describing that the elemental figures EL11 are arranged on the straight line LN1, but is not actually printed on the sheet Q.

In FIG. 5, each elemental figure EL11 includes six dots DT arranged in the main scanning direction. Nonetheless, the number of dots DT included in the single elemental figure EL11 may be an arbitrary number. In the first test pattern TP11 exemplified in FIG. 5, the direction in which the elemental figures EL11 are arranged is expressed as the direction of the first vector (X, Y)=(A1, B1), where |A1|=3, and |B1|=1. It is noted that |A1| represents the absolute value of A1, and that |B1| represents the absolute value of B1. Nonetheless, the value |A1| may be more than three.

For instance, the direction of the first vector (X, Y)=(A1, B1) may be set based on integers A1 and B1 that satisfy an equality "|A1|>|B1|>0." The equality "|A1|>|B1|>0" denotes that an angle formed between the direction of the first vector and the X-axis direction is less than 45 degrees. In order to make the first test pattern TP11 close to the X-axis, |A1| is preferred to be a large value, and |B1| is preferred to be equal to one.

After the first test pattern TP11 has been formed, the controller 10 controls, via the printing unit driver 30, the sheet conveyor 61 to rotate the conveyance roller 613 by a particular amount L1 thereby conveying the sheet Q over the particular amount L1 downstream in the sheet conveyance direction (S130). Thereafter, when making a negative determination in S140, the controller 10 again performs the first pattern forming process (S120) in which the recording head 40 is controlled to form another first test pattern TP11 on the sheet Q. The process of conveying the sheet Q over the particular amount L1 is carried out by controlling a rotational amount of the conveyance roller 613. Therefore, an actual sheet conveyance distance in S130 contains an error relative to the particular amount L1.

After S130, the controller 10 determines whether the first test pattern TP11 first formed on the sheet Q has reached a second recording area R2 of the recording area R0 (S140). Hereinafter, the first test pattern TP11 first formed on the sheet Q may be simply referred to as a "head first test pattern TP11" or a "first-formed first test pattern TP11" to differentiate it from other first test patterns TP11 to be subsequently formed on the sheet Q. The second recording area R2 is an area in which a second test pattern TP21 is formed. When determining that the head first test pattern TP11 has not reached the second recording area R2 (S140: No), the controller 10 goes to S120. Namely, until the first-formed first test pattern TP11 reaches the second recording area R2, the controller 10 repeatedly performs the processes of making the negative determination in S140 (S140: No), controlling the recording head 40 to form the first test pattern TP11 on the sheet Q (S120), and controlling the sheet conveyor 61 to convey the sheet Q over the particular amount L1 (S130). Meanwhile, when determining that the head first test pattern TP11 has reached the second recording area R2 (S140: Yes), the controller 10 goes to S150. FIG. 4B shows the first test patterns TP11 that are formed at intervals of the distance L1 (i.e., the particular amount L1) in the Y-axis direction by repeating the steps S120 and S130.

The particular amount L1, which corresponds to the formation interval of the first test patterns TP11 in the Y-axis direction, is as long as a part of a length L0 (see FIG. 2) divided by an integer. As shown in FIG. 2, the length L0 is a length between an upstream end of the first recording area R1 and an upstream end of the second recording area R2 in the sub scanning direction, within the recording area R0. Further, the particular amount L1 is as long as a part of an outer circumferential length of the conveyance roller 613 divided by an integer. The outer circumferential length of the conveyance roller 613 corresponds to a sheet conveyance distance when the conveyance roller has made a single rotation.

In the illustrative embodiment, a conveyance distance error between the rotational amount of the conveyance roller 613 and the actual sheet conveyance distance depends on a rotational phase of the conveyance roller 613 in sheet conveyance. In the illustrative embodiment, in order to suppress an influence of the above conveyance distance error depending on the rotational phase, a conveyance distance error is determined at each of different rotational phases that are defined by dividing the outer circumferential length of the conveyance roller 613 into a plurality of sections. The formation of the first test patterns TP11 at intervals of the particular amount L1 in the Y-axis direction is for determining a conveyance distance error at each rotational phase of the conveyance roller 613.

When determining that the first test pattern TP11 first formed on the sheet Q has reached the second recording area R2 (S140: Yes), the controller 10 goes to S150. In S150, the controller 10 performs a both-patterns forming process.

In the both-patterns forming process, the controller 10 controls, via the printing unit driver 30, the recording head 40 to form an additional first test pattern TP11 and a second test pattern TP21 on the sheet Q (S150). Specifically, in S150, the controller 10 controls the recording head 40 to form the first test pattern TP11 on a portion of the sheet Q that is positioned in the first recording area R1, using the first nozzle group N1, and form the second test pattern TP21 on a portion of the sheet Q that is positioned in the second recording area R2, using the second nozzle group N2 (see FIG. 4C). The second recording area R2 corresponds to a partial area of the recording area R0 that is positioned under the second nozzle group N2. In other words, the second recording area R2 is an area of the recording area R0 where the recording head 40 is allowed to perform image formation using the second nozzle group N2. Among the nozzle group N0, the second nozzle group N2 is positioned downstream of the first nozzle group N1 in the sheet conveyance direction.

FIG. 4C exemplifies the second test pattern TP21 formed on the sheet Q. The second test pattern TP21 is macroscopically or approximately a straight line that is slightly inclined relative to the main scanning direction at a different degree of inclination from the first test pattern TP11. Namely, the second test pattern TP21 is macroscopically or approximately inclined relative to each of the main scanning direction and the first test pattern TP11. FIG. 4C shows a state where the second test pattern TP21 is formed in the first-executed S150 so as to intersect the head first test pattern TP11 on the sheet Q.

Specifically, the second test pattern TP21 is a test pattern in which a rectangular elemental figure EL21 as a constituent of the test pattern is repeatedly formed to be arranged on a virtual straight line LN2. The virtual straight line LN2 is inclined relative to the main scanning direction. Each elemental figure EL21 includes a plurality of dots DT arranged linearly or in a rectangular shape as shown in FIG. 6, in the same manner as the first test pattern TP11.

Figure 6:
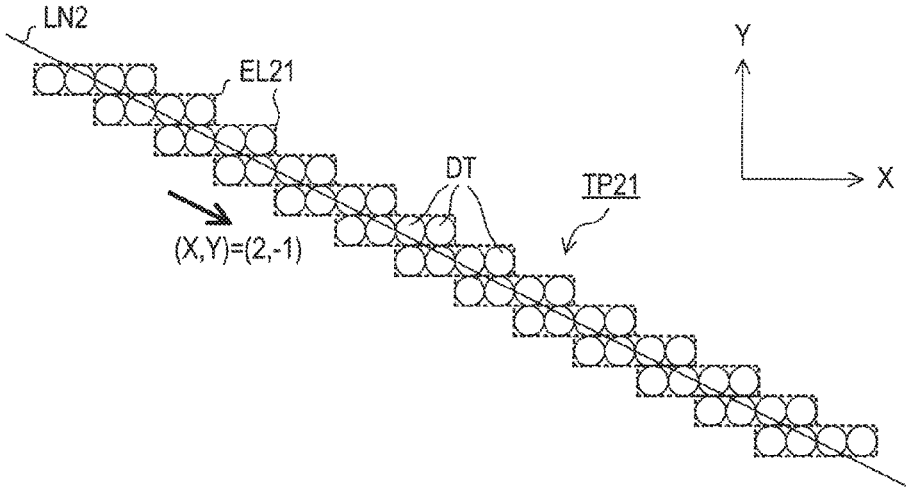
FIG. 6 is an enlarged view of a second test pattern in the illustrative embodiment according to one or more aspects of the present disclosure.

In an example shown in FIG. 6, the second test pattern TP21 is a geometrical pattern in which a plurality of uniform elemental figures EL21 are arranged in a direction of a second vector (X, Y)=(2, −1) along the virtual straight line LN2. Each uniform elemental figure EL21 includes four dots DT arranged linearly in the X-axis direction. It is noted that the virtual straight line LN2 is only used for describing that the elemental figures EL21 are arranged on the straight line LN2, but is not actually printed on the sheet Q.

In FIG. 6, each elemental figure EL21 includes four dots DT arranged in the main scanning direction. Nonetheless, the number of dots DT included in the single elemental figure EL21 may be an arbitrary number. In the second test pattern TP21 exemplified in FIG. 6, the direction in which the elemental figures EL21 are arranged is expressed as the direction of the second vector (X, Y)=(A2, B2), where |A2|=2, and |B2|=1. Nonetheless, the value |A2| may be more than two.

For instance, the direction of the second vector (X, Y)=(A2, B2) may be set based on integers A2 and B2 that satisfy an equality "|A2|>|B2|>0" and "(B1/A1)×(B2/A2)>0" within such a range that the direction of the second vector is not parallel to the direction of the first vector. The equality "|A2|>|B2|>0" denotes that an angle formed between the direction of the second vector and the X-axis direction is less than 45 degrees. The equality "(B1/A1)*(B2/A2)>0" denotes that the inclination of the virtual straight line LN2 along the direction of the second vector has the same one of the positive and negative signs as the inclination of the virtual straight line LN1 along the direction of the first vector. In order to make the second test pattern TP21 close to the X-axis, |A2| is preferred to be a large value, and |B2| is preferred to be equal to one. Furthermore, in order to make small an angle at which the first test pattern TP11 intersects the second test pattern TP21, |A2| is preferred to be close to |A1|.

After the second test pattern TP21 has been formed, the controller 10 controls, via the printing unit driver 30, the sheet conveyor 61 to convey the sheet Q over the particular amount L1 downstream in the sheet conveyance direction (S160). Thereafter, when making a negative determination in S170, the controller 10 again performs the both-patterns forming process (S150). In both-patterns forming process (S150), as shown in FIG. 4D, the recording head 40 is controlled to form another first test pattern TP11 on the sheet Q with the first nozzle group N1 and form another second test pattern TP21 with the second nozzle group N2 to intersect the first test pattern TP11 that has reached the second recording area R2.

After S160, the controller 10 determines whether a predetermined number of first test patterns TP11 have been completely formed (S170). When determining that the predetermined number of first test patterns TP11 have not been completely formed (S170: No), the controller 10 goes to S150. Namely, until the predetermined number of first test patterns TP11 are completely formed, the controller 10 repeatedly performs the processes of making the negative determination in S170 (S170: No), controlling the recording head 40 to form the first test pattern TP11 and the second test pattern TP21 on the sheet Q (S150), and controlling the sheet conveyor 61 to convey the sheet Q over the particular amount L1 (S160).

Meanwhile, when determining that the predetermined number of first test patterns TP11 have been completely formed (S170: Yes), the controller 10 goes to S180. It is noted that, according to aspects of the present disclosure, the controller 10 may stop forming the first test patterns TP11 at a point of time when the head first test pattern TP11 reaches the second recording area R2. In this case, in response to making the affirmative determination in S140 (S140: Yes), the controller 10 may go to S180 without executing any of the steps S150 to S170.

In S180, the controller 10 performs a second pattern forming process. In the second pattern forming process, the controller 10 controls, via the printing unit driver 30, the recording head 40 to form a second test pattern TP21 on a portion of the sheet Q that is positioned in the second recording area R2 with the second nozzle group N2 (S180). Namely, the recording head 40 is controlled to form the second test pattern TP21 to intersect the first test pattern TP11 that has reached the second recording area R2.

Afterward, the controller 10 determines whether the second test pattern TP21 has been formed for each of all the first test patterns TP11 (S190). When determining that the second test pattern TP21 has not been formed for each of all the first test patterns TP11 (S190: No), the controller 10 goes to S200. Meanwhile, when determining that the second test pattern TP21 has been formed for each of all the first test patterns TP11 (S190: Yes), the controller 10 goes to S210.

In S200, the controller 10 controls the sheet conveyor 61 to convey the sheet Q over the particular amount L1 in the same manner as executed in S130. Thereafter, the controller 10 goes to S180. Thus, until the second test pattern TP21 is formed for each of all the first test patterns TP11, the controller 10 repeatedly performs the processes of making the negative determination in S190 (S190: No), controlling the sheet conveyor 61 to convey the sheet Q over the particular amount L1 (S200), and controlling the recording head 40 to form the second test pattern TP21 on the sheet Q (S180). Then, when the second test pattern TP21 has been formed for each of all the first test patterns TP11 (S190: Yes), the controller 10 performs a sheet discharging process (S210).

Specifically, in S210, the controller 10 controls, via the printing unit driver 30, the sheet conveyor 61 to convey and discharge the sheet Q onto the discharge tray (not shown). Further, the controller 10 controls the user interface 90 to display, on the display of the user interface 90, a message that prompts the user to place the sheet Q with the test patterns printed thereon on the document table of the scanning unit 70 and input a scanning instruction (S220). Thereafter, the controller 10 waits until a scanning instruction is input through the user interface 90 (S230).

When a scanning instruction has been input, the controller 10 performs a scanning process (S240). Specifically, in S240, the controller 10 controls the scanning unit 70 to scan the sheet Q with the test patterns printed thereon, and acquires image data expressing the scanned image from the scanning unit 70.

Further, the controller 10 calculates a positional displacement, from a reference point, of an intersection between each first test pattern TP11 and the corresponding second test pattern TP21 based on the image data acquired from the scanning unit 70, and calculates a conveyance distance error of the sheet Q based on the calculated positional displacement (S250). Based on the conveyance distance error calculated in S250, the controller 10 updates the particular control parameter (included in the control parameters stored in the NVRAM 17) that represents the association between the rotational quantity of the conveyance roller 613 and the sheet conveyance distance (S260). Thereafter, the controller 10 terminates the test printing process shown in FIG. 3.

An explanation will be provided about how to calculate the conveyance distance error of the sheet Q. The controller 10 calculates a conveyance distance error of the sheet Q for a combination of each of the first test patterns TP11 formed on the sheet Q and a corresponding one of the second test patterns TP21 formed on the sheet Q, by performing the following process in S250 based on the image data acquired from the scanning unit 70. Then, based on the calculation results, the controller 10 updates the particular control parameter in S260.

Figure 7:
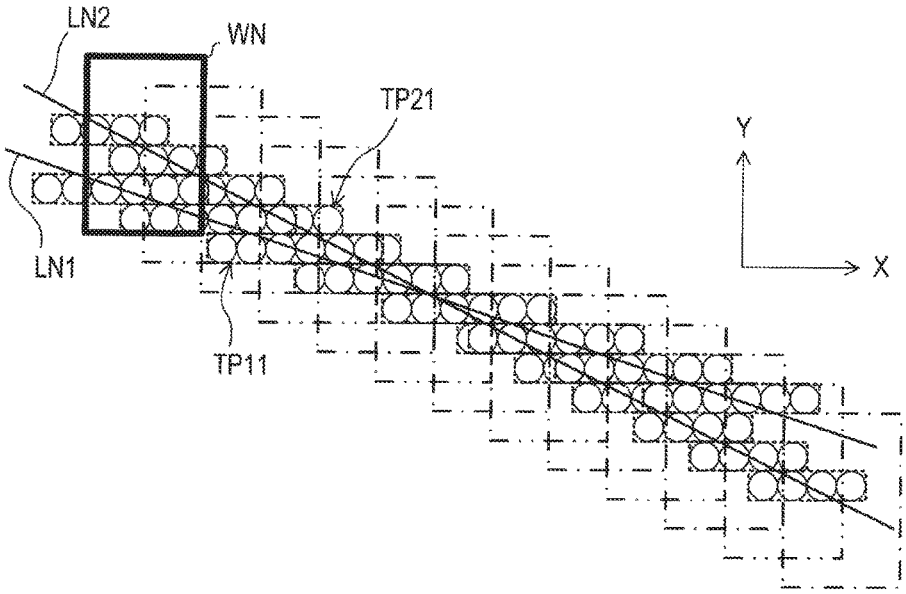
FIG. 7 is an illustration for showing how to detect a position of an intersection between the first test pattern and the second test pattern in the illustrative embodiment according to one or more aspects of the present disclosure.

Specifically, as shown in FIG. 7, with respect to each of the first test patterns TP11 in the image data, the controller 10 slides a position of a rectangular window WN (indicated by a solid line) along the first test pattern TP11 on a step-by-step basis of a predetermined amount (as indicated by alternate long and short dash lines). Then, the controller 10 calculates a density (e.g., a total area of the test patterns TP11 and TP21 per a particular area of the rectangular window WN) within the rectangular window WN in each position of the rectangular window WN. Thereby, the density in each position along each first test pattern TP11 is calculated. The rectangular window WN may be defined as a rectangular window having a longitudinal direction along the sub scanning direction. A length of the rectangular window WN in the sub scanning direction may be set as a length including both of the first test pattern TP11 and the second test pattern TP21.

As a total area of the test patterns TP11 and TP21 included in the rectangular window WN becomes smaller, the density becomes lower. Accordingly, a change of the density (hereinafter, which may be referred to as a "density distribution") along the first test pattern TP11 is likely to have a local minimum value at the intersection between the first test pattern TP11 and the second test pattern TP21. In S250, the controller 10 identifies a position in the X-axis direction where the density distribution (i.e., the change of the density) along the first test pattern TP11 has the local minimum value, as a position of the intersection between the first test pattern TP11 and the second test pattern TP21.

Figure 8A:
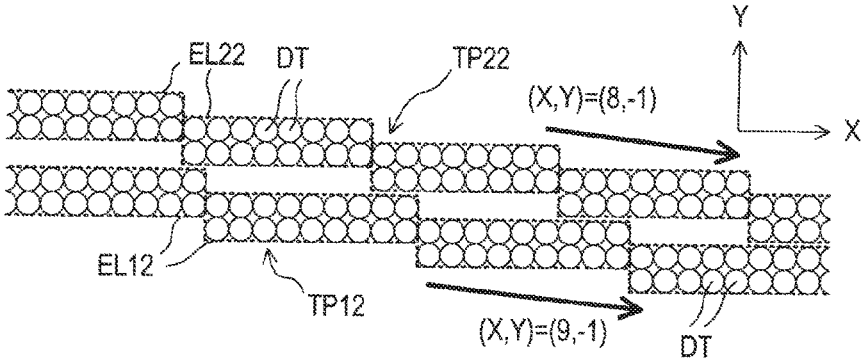
FIG. 8A is an enlarged view showing a first test pattern and a second test pattern in a modification according to one or more aspects of the present disclosure.
Figure 8B:
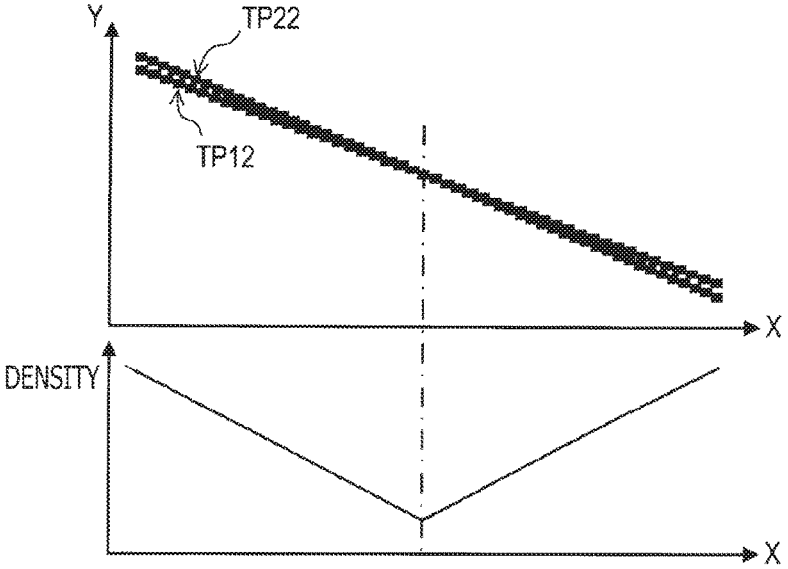
FIG. 8B shows a relationship between a density distribution (i.e., a density change) of the first and second test patterns in a main scanning direction (i.e., an X-axis direction) and a position of an intersection between the first and second test patterns in the main scanning direction, in the modification according to one or more aspects of the present disclosure.

FIG. 8A shows a first test pattern TP12 and a second test pattern TP22 that are different from the first test pattern TP11 and the second test pattern TP21 shown in FIGS. 4A-4D and 5-7, respectively. FIG. 8B provides an upper graph showing a dot distribution of the first test pattern TP12 and the second test pattern TP22 and a lower graph showing a density distribution calculated to identify a position of the intersection between the first test pattern TP12 and the second test pattern TP22, in association with each other.

As shown in FIG. 8A, the first test pattern TP12 is formed as a geometrical pattern including a plurality of elemental figures EL12 arranged in a direction of a first vector (X, Y)=(9, −1). Each elemental figure EL12 has two rows each of which includes nine dots DT arranged in the X-axis direction. Namely, each elemental figure EL12 is a cluster of dots defined by nine pixels in the X-axis direction and two pixels in the Y-axis direction. The second test pattern TP22 is formed as a geometrical pattern including a plurality of elemental figures EL22 arranged in a direction of a second vector (X, Y)=(8, −1). Each elemental figure EL22 has two rows each of which includes eight dots DT arranged in the X-axis direction. Namely, each elemental figure EL22 is a cluster of dots defined by eight pixels in the X-axis direction and two pixels in the Y-axis direction. As understood from FIG. 8B, a density distribution of the present example has a (local) minimum value at an intersection between the first test pattern TP12 and the second test pattern TP22. The combination of the first test pattern TP11 and the second test pattern TP21 provides the same density distribution as the density distribution for the combination of the first test pattern TP12 and the second test pattern TP22.

After identifying a position in the X-axis direction of the intersection between the first test pattern TP11 and the second test pattern TP21 based on the density distribution, the controller 10 calculates a positional displacement ΔX in the X-axis direction between the identified position of the intersection and the reference point. The reference point corresponds to a position of the intersection between the first test pattern TP11 and the second test pattern TP21 when the conveyance distance error of the sheet Q is zero. Positional information of the reference point may be stored in the NVRAM 17.

Figure 9:
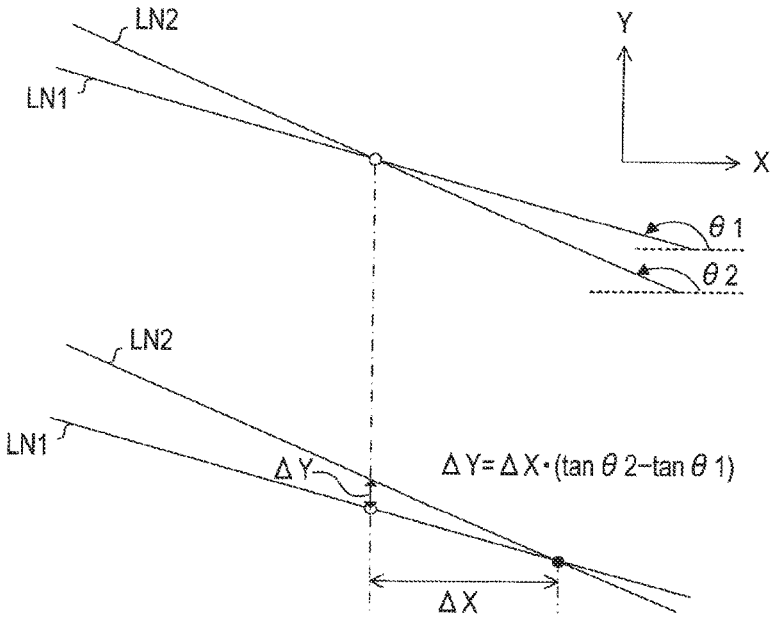
FIG. 9 is an illustration for geometrically showing a relationship between a positional displacement of the intersection between the first and second test patterns in the main scanning direction and a conveyance distance error in a sub scanning direction (i.e., a Y-axis direction), in the illustrative embodiment according to one or more aspects of the present disclosure.

In an upper area of FIG. 9, a white circle indicates an intersection between the virtual straight line LN1 along the first test pattern TP11 and the virtual straight line LN2 along the second test pattern TP21 when the conveyance distance error of the sheet Q is zero. The white circle corresponds to the reference point. In a lower area of FIG. 9, a black circle indicates an intersection between the virtual straight line LN1 along the first test pattern TP11 and the virtual straight line LN2 along the second test pattern TP21 when the second test pattern TP21 is formed in a situation where a sheet conveyance distance is shorter than when the conveyance distance error is zero and where the sheet Q is positioned |ΔY| upstream in the sheet conveyance direction relative to a position of the sheet Q when the conveyance distance error is zero. As understood from positional relationships shown in FIG. 9, a relationship between the conveyance distance error ΔY in the sub scanning direction and the positional displacement ΔX between the intersection and the reference point in the main scanning direction is expressed as follows.

$$\Delta Y=\Delta X*(\tan\theta 2-\tan\theta 1)$$

In the above expression, tan θ1 corresponds to an inclination of the virtual straight line LN1 along the first test pattern TP11, i.e., tan θ1=B1/A1. Further, tan θ2 corresponds to an inclination of the virtual straight line LN2 along the second test pattern TP21, i.e., tan θ2=B2/A2. When ΔY is a positive value, it denotes that the sheet Q is over-conveyed by |ΔY| downstream in the sheet conveyance direction in comparison with when the conveyance distance error is zero. When ΔY is a negative value, it denotes that the sheet Q is under-conveyed by |ΔY| upstream in the sheet conveyance direction in comparison with when the conveyance distance error is zero. In the above expression, ΔX is a value on the X-axis having the unit length in the main scanning direction, and ΔY is a value on the Y-axis having the unit length in the sub scanning direction. When ΔX and ΔY are required to be expressed on the basis of inch unit, tan θ1 may be expressed as tan θ1=(B1*DP2), and tan θ2 may be expressed as tan θ2=(B1*DP2)/(A2*DP1).

In S250, the controller 10 calculates the conveyance distance error ΔY of the sheet Q by substituting the calculated positional displacement ΔX in the expression ΔY=ΔX*(tan θ2−tan θ1). Thus, the controller 10 calculates the conveyance distance error ΔY of the sheet Q when the conveyance roller 613 is rotated such that the sheet Q is conveyed over the distance L0, for each first test pattern TP11 (i.e., for each rotational phase of the conveyance roller 613). Based on the conveyance distance error ΔY, the controller 10 updates (corrects) the particular control parameter that represents the association between the rotational quantity of the conveyance roller 613 and the sheet conveyance distance for each rotational phase of the conveyance roller 613 (S260).

As understood from the above expression, the absolute positional displacement |ΔX| of the intersection between the first test pattern TP11 and the second test pattern TP21 depending on the absolute conveyance distance error |ΔY| increases as an angle |Δθ|=|θ2−θ1| between the first test pattern TP11 and the second test pattern TP21 decreases. Furthermore, in general, as understood from that the differential of tan θ is $1/\cos^2\theta$, the inclination of tan θ decreases as θ decreases. Namely, when |Δ θ| is constant, a value |tan θ2−tan θ1| decreases as the angles θ1 and θ2 decrease.

Accordingly, in order to increase the absolute positional displacement |ΔX| of the intersection between the first test pattern TP11 and the second test pattern TP21 depending on the absolute conveyance distance error |ΔY|, it is preferred to decrease the angle |Δθ| between the first test pattern TP11 and the second test pattern TP21 in a state where the first test pattern TP11 and the second test pattern TP21 are inclined to be close to the main scanning direction (i.e., the X-axis direction).

Therefore, preferably, the first test pattern TP11 and the second test pattern TP21 may be formed in such a manner that |B1|=|B2|=1, that a difference between |A1| and |A2| is small, and that |A1| and |A2| are large values.

Figure 10:
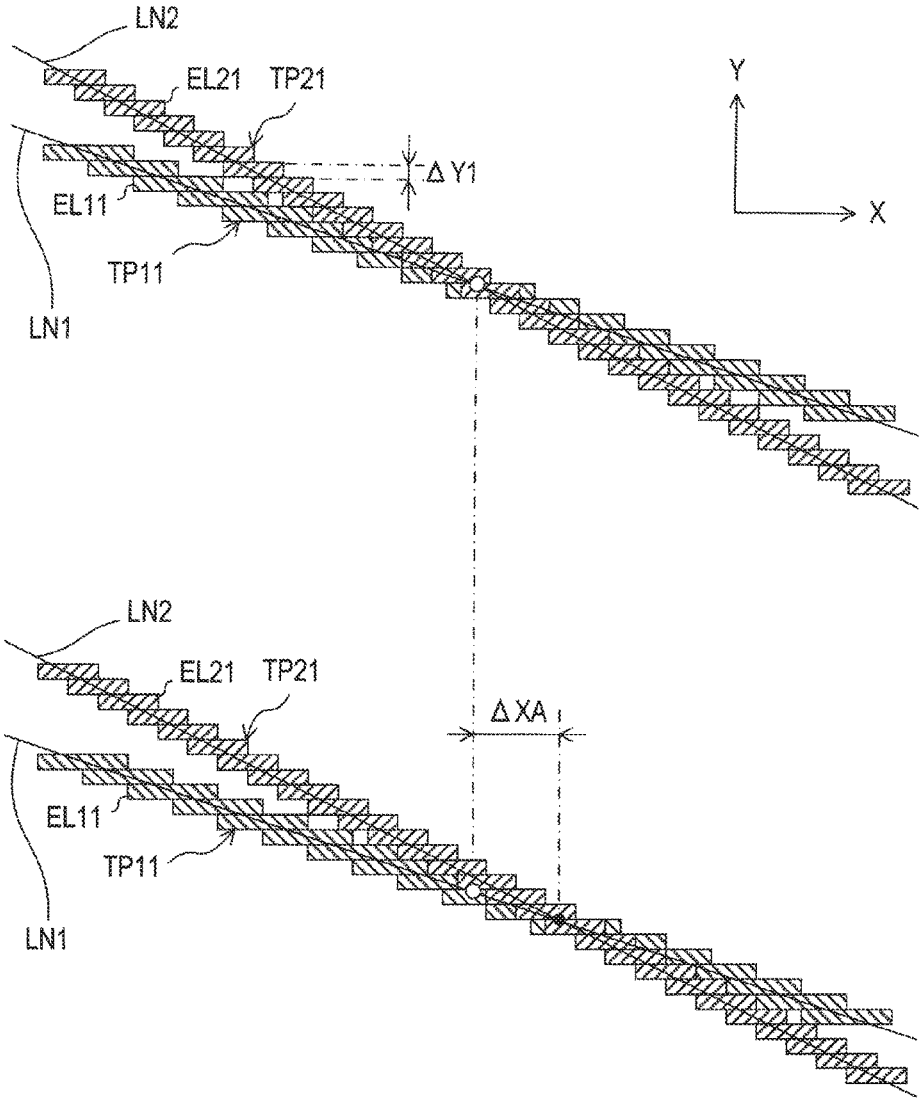
FIG. 10 is an illustration for showing a positional displacement of the intersection between the first and second test patterns from a reference point in the illustrative embodiment according to one or more aspects of the present disclosure.

From a comparison between FIGS. 10 and 13, it is understood that the test pattern printing of the illustrative embodiment (see e.g., FIG. 10) causes a larger positional displacement of the intersection between the test patterns formed thereby with respect to a conveyance distance error of the sheet Q than a known test pattern printing method (see e.g., FIG. 13). In an upper area of FIG. 10, a white circle indicates an intersection between the first test pattern TP11 and the second test pattern TP21 as illustrative test patterns according to aspects of the present disclosure when there is no conveyance distance error caused by conveyance of the sheet Q. In a lower area of FIG. 10, a black circle indicates an intersection between the first test pattern TP11 and the second test pattern TP21 when a conveyance distance error of ΔY1 (one pixel) in the sub scanning direction is caused by the conveyance of the sheet Q. In this situation, a positional displacement in the main scanning direction between the intersection indicated by the black circle and the reference point indicated by the white circle is defined as ΔXA.

In an upper area of FIG. 13, a white circle indicates an intersection between a first test pattern TP10 and a second test pattern TP20 as test patterns formed in the known test pattern printing method when there is no conveyance distance error caused by the conveyance of the sheet Q. In a lower area of FIG. 13, a black circle indicates an intersection between the first test pattern TP10 and the second test pattern TP20 when a conveyance distance error of ΔY1 (one pixel) in the sub scanning direction is caused by the conveyance of the sheet Q. In this situation, a positional displacement in the main scanning direction between the intersection indicated by the black circle and the reference point indicated by the white circle is defined as ΔXB.

According to the known test pattern printing method, the first test pattern TP10 is parallel to the main scanning direction. Therefore, since an angle formable between the first test pattern TP10 and the second test pattern TP20 is influenced by the dot pitch in the sub scanning direction, it is not possible to make so small the angle between the first test pattern TP10 and the second test pattern TP20. Accordingly, when the conveyance distance error of the sheet Q is not large, the positional displacement of the intersection from the reference point is small. Thus, in such a case, it is difficult to accurately calculate the conveyance distance error based on the positional displacement. Further, the second test pattern TP20 is not formed in a strictly straight line but in a terraced shape. Hence, even though the angle between the first test pattern TP10 and the second test pattern TP20 is made small, the intersection is not displaced from the reference point in the main scanning direction as long as the conveyance distance error of the sheet Q is less than a length of one pixel in the sub scanning direction. Thus, according to the known test pattern printing method, it is impossible to detect a conveyance distance error less than a dot pitch (e.g., a nozzle interval) in the sub scanning direction.

In contrast, according to the illustrative embodiment, both of the first test pattern TP11 and the second test pattern TP21 are inclined relative to the main scanning direction. Therefore, it is possible to reduce the angle between the first test pattern TP11 and the second test pattern TP21 without being so influenced by the dot pitch in the sub scanning direction. Accordingly, as understood from the comparison between FIGS. 10 and 13, according to the illustrative embodiment, it is possible to remarkably enlarge the positional displacement of the intersection in the main scanning direction with respect to the conveyance distance error of the sheet Q in the sub scanning direction in comparison with the known test pattern printing method. Thus, according to the illustrative embodiment, it is possible to accurately the conveyance distance error of the sheet Q in the sub scanning direction based on the positional displacement of the intersection in the main scanning direction. Further, according to the illustrative embodiment, even though the conveyance distance error of the sheet Q is less than a length of one pixel in the sub scanning direction, the intersection is displaced from the reference point in the main scanning direction. Thus, it is possible to accurately calculate such a small conveyance distance error. According to the known test pattern printing method, in order to detect a conveyance distance error less than the dot pitch in the sub scanning direction, the sheet Q needs to be finely conveyed. Nonetheless, according to the illustrative embodiment, it is possible to detect a conveyance distance error less than the dot pitch in the sub scanning direction without having to so finely convey the sheet Q. Thus, according to the illustrative embodiment, it is possible to accurately detect the conveyance distance error of the sheet Q while quickly and efficiently forming the test patterns.

The first test pattern TP11 and the second test pattern TP21 shown in FIGS. 4A to 7 and the first test pattern TP12 and the second test pattern TP22 shown in FIG. 8 are merely examples, and may be replaced with other test patterns. For instance, the first test pattern TP11 may be replaced with the second test pattern TP21. The first test pattern TP11 and the second test pattern TP21 may be changed to test patterns exemplified in FIGS. 11A to 11E. Each of FIGS. 11A to 11E shows a part of each of the test patterns TP3, TP4, TP5, TP6 in an enlarged manner, in the same way as FIGS. 5 and 6 show the test patterns TP11 and TP21, respectively. The first test patterns TP11 and TP12 and the second test patterns TP21, and TP22 may be changed to any of the test patterns TP3, TP4, TP5, TP6, and TP7 exemplified in FIGS. 11A to 11E, or may be changed to other test patterns.

Figure 11A:
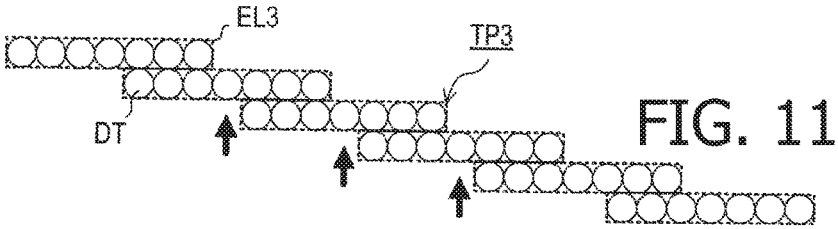
Figure 11B:
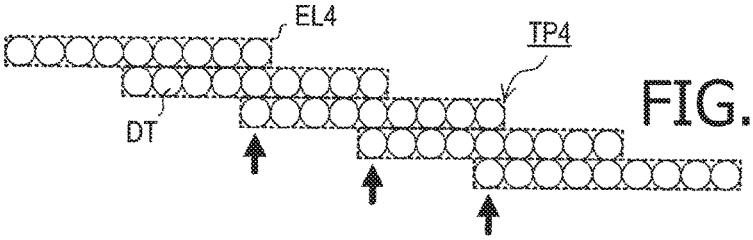

The test pattern TP3 shown in FIG. 11A is formed as a geometrical pattern in which a plurality of uniform elemental figures EL3 are arranged in a direction of a vector (X, Y)=(4, −1). Each uniform elemental figure EL3 includes seven dots DT arranged linearly in the X-axis direction. The test pattern TP4 shown in FIG. 11B is formed as a geometrical pattern in which a plurality of uniform elemental figures EL4 are arranged in a direction of the vector (X, Y)=(4, −1). Each uniform elemental figure EL4 includes nine dots DT arranged linearly in the X-axis direction.

The test patterns TP3 and TP4 are similar to the test patterns TP11 and TP21 shown in FIGS. 5 and 6, but are different from them in the following points. The test pattern TP11 shown in FIG. 5 includes the elemental figures EL11 each of which has a width of six pixels in the X-axis direction. The width of each elemental figure EL11 in the X-axis direction is an integral multiple of the X-axis component A1=3 of the vector (X, Y)=(3, −1) that defines the direction in which the elemental figures EL11 are arranged. On the other hand, the test pattern TP3 shown in FIG. 11A includes the elemental figures EL3 each of which has a width of seven pixels in the X-axis direction. The width of each elemental figure EL3 in the X-axis direction is not an integral multiple of the X-axis component (i.e., 4) of the vector (X, Y)=(4, −1) that defines the direction in which the elemental figures EL3 are arranged. Further, the test pattern TP4 shown in FIG. 11B includes the elemental figures EL4 each of which has a width of nine pixels in the X-axis direction. The width of each elemental figure EL4 in the X-axis direction is not an integral multiple of the X-axis component (i.e., 4) of the vector (X, Y)=(4, −1) that defines the direction in which the elemental figures EL4 are arranged. The test pattern TP21 shown in FIG. 6 includes the elemental figures EL21 each of which has a width of four pixels in the X-axis direction. The width of each elemental figure EL21 in the X-axis direction is an integral multiple of the X-axis component A2=2 of the vector (X, Y)=(2, −1) that defines the direction in which the elemental figures EL21 are arranged.

A particular test pattern (e.g., TP3 and TP4), which includes elemental figures each of which has a width that is not an integral multiple of the X-axis component of a vector (X, Y)=(A, B) to define the arrangement direction of the elemental figures, has particular portions as indicated by bold type arrows in FIGS. 11A and 11B. Specifically, the particular portions of the particular test pattern have a different width in the sub scanning direction from the width of the other portions of the particular test pattern. Owing to the unevenness of the width of the particular test pattern in the sub scanning direction, the particular test pattern is formed in the shape of a macroscopically or approximately straight line with an uneven width. The width unevenness of the particular test pattern is likely to cause a minute fluctuation in the density distribution determined in S250 and make it difficult to identify the local minimum value of the density corresponding to the intersection between the test patterns.

Accordingly, as shown in FIGS. 5 and 6, a test pattern is preferred to be formed to satisfy the following relationship among a vector (X, Y)=(A, B) to define an arrangement direction of elemental figures included in the test pattern, and a width of each elemental figure in the X-axis direction, and a width of each elemental figure in the Y-axis direction. Specifically, the test pattern is preferred to be formed as a geometrical pattern in which a plurality of rectangular or linear elemental figures are arranged in the arrangement direction defined by the vector (X, Y)=(A, B) at intervals of a distance corresponding to the vector (X, Y)=(A, B) (i.e., the elemental figures are arranged in such a manner that one elemental figure is away from another by A pixels in the X-axis direction and B pixels in the Y-axis direction). In this case, each rectangular or linear elemental figure is preferred to be formed as a cluster of dots having a count of pixels in the Y-axis direction corresponding to the Y-axis component B of the vector (X, Y)=(A, B) and a count of pixels in the X-axis direction that is an integral multiple of (e.g., may be one time as many as) the X-axis component A of the vector (X, Y)=(A, B).

Alternatively, as shown in FIG. 8, the test pattern may be formed as a geometrical pattern in which a plurality of rectangular or linear elemental figures are arranged in the arrangement direction defined by the vector (X, Y)=(A, B) at intervals of the distance corresponding to the vector (X, Y)=(A, B). Each rectangular or linear elemental figure is formed as a cluster of dots having a count of pixels in the X-axis direction equal to the X-axis component A of the vector (X, Y)=(A, B). The test patterns TP12 and TP22 shown in FIG. 8 satisfy the above requirements. Therefore, in the test patterns TP12 and TP22 shown in FIG. 8, there is no unevenness of their width in the sub scanning direction as shown in FIGS. 11A and 11B. Accordingly, it is possible to suppress a minute fluctuation in the density distribution and to accurately identify the local minimum value of the density corresponding to the intersection between the test patterns.

Figure 11C:
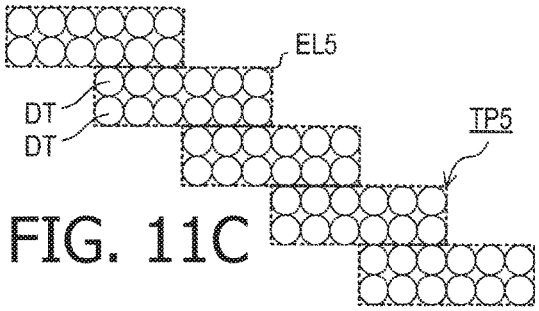

A test pattern TP5 shown in FIG. 11C is formed as a geometrical pattern in which a plurality of elemental figures EL5 are arranged in a direction of a vector (X, Y)=(3, −2). Each elemental figure EL5 has two rows each including six dots DT arranged in the X-axis direction.

Figure 11D:
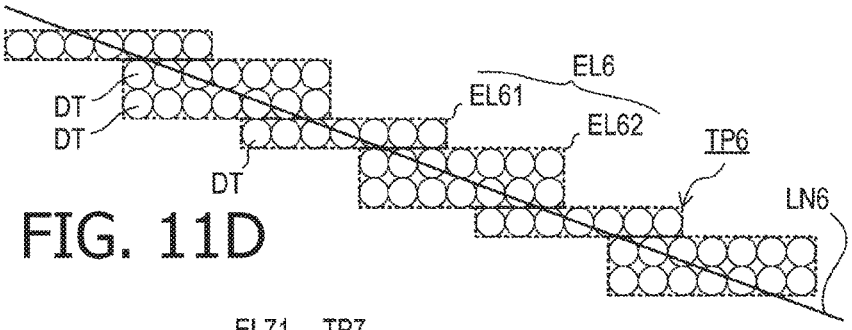

A test pattern TP6 shown in FIG. 11D is formed as a geometrical pattern in which elemental figures EL61 and elemental figures EL62 are alternately arranged on a virtual straight line LN6. Each elemental figure EL61 has a single row including seven dots DT arranged in the X-axis direction. Each elemental figure EL62 has two rows each including seven dots DT arranged in the X-axis direction. In other words, the test pattern TP6 shown in FIG. 11D may be interpreted as a geometrical pattern in which a plurality of non-rectangular elemental figures EL6 are arranged in a direction of a vector (X, Y)=(8, −3) at intervals of a distance corresponding to the vector (X, Y)=(8, −3). Each non-rectangular elemental figure EL6 is formed by integrating the different two elemental figures EL61 and EL62.

Figure 11E:
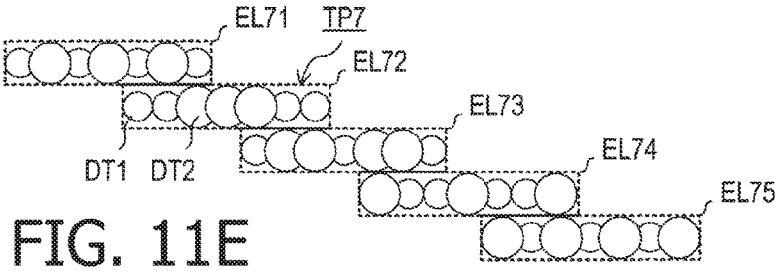

A test pattern TP7 shown in FIG. 11E is formed as a geometrical pattern in which different elemental figures EL71, EL72, EL73, EL74, and EL75 are arranged in a direction of a vector (X, Y)=(4, −1). Each of the different elemental figures EL71, EL72, EL73, EL74, and EL75 has a single row of seven dots formed by arranging two types of dots DT1 and DT2 different in size in the X-axis direction in a unique order. The dot size may be changed by changing the size of an ink droplet discharged from a nozzle.

As an example different from the aforementioned examples, a first test pattern and a second test pattern may be macroscopically or approximately formed as linear geometrical patterns (including patterns formed in the shape of a straight dashed line) that have mutually-different inclinations relative to the main scanning direction. Preferably, the first test pattern and the second test pattern may be formed in a straight line with a uniform width. Further preferably, the first test pattern and the second test pattern may be formed to intersect each other at a small angle and have a small inclination angle with respect to the main scanning direction. By using the first test pattern and the second test pattern formed as above, it is possible to accurately calculate the conveyance distance error of the sheet Q.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

(Modifications)

Aspects of the Present Disclosure may be Applied to Line Inkjet Printers and Laser Printers.

Hereinafter, a modification according to aspects of the present disclosure will be described with reference to FIG. 12. FIG. 12 shows a line inkjet printer 101 that includes a plurality of line inkjet heads 141, 142, 143, and 144 as recording heads. In FIG. 12, elements provided with the other reference characters are configured substantially in the same manner as elements provided with the same reference characters in FIG. 2. Each of the line inkjet heads 141, 142, 143, and 144 includes a nozzle group N4 of ink discharge nozzles arranged in the main scanning direction. The line inkjet printer 101 is configured to intermittently discharge ink droplets, onto a sheet Q relatively moving along the sub scanning direction, from the nozzle groups N4 each having the ink discharge nozzles arranged in the main scanning direction, thereby forming an image on the sheet Q without moving the recording heads along the main scanning direction. In the line inkjet printer 101 shown in FIG. 12, the line inkjet heads 141, 142, 143, and 144, each of which is a specific recording head for a corresponding color and disposed along the main scanning direction, are arranged in the sub scanning direction. When aspects of the present disclosure are applied to the line inkjet printer 101, a first test pattern may be formed with at least one of the upstream line inkjet heads 141, 142, and 143 that are positioned upstream of the line inkjet head 144 in the sheet conveyance direction (i.e., the sub scanning direction). Further, in this case, a second test pattern may be formed with at least one of the downstream line inkjet heads 142, 143, and 144 that are positioned downstream of the line inkjet head 141 in the sheet conveyance direction.

As an example of laser printers, a laser printer (e.g., a tandem type laser printer) has been known that is configured to form a color image on a recording medium (e.g., a sheet Q or a transfer belt) by sequentially superposing one toner image of a specific color on another toner image of a different color on the recording medium. In the laser printer, when the toner images of different colors are transferred onto the recording medium, the toner images are required to be accurately superposed. The accurate superposing of the toner images needs accurate conveyance control for the recording medium. When aspects of the present disclosure are applied to the laser printer, it is possible to accurately calculate a conveyance distance error of the recording medium by forming and reading test patterns as exemplified in the aforementioned illustrative embodiment. Thus, it is possible to suppress the conveyance distance error of the recording medium and accurately superpose the toner images of different colors on the recording medium.

In the aforementioned illustrative embodiment, a position of an intersection between test patterns formed on a sheet Q is identified by analyzing the image data acquired by the scanning unit 70. Nonetheless, the position of the intersection between the test patterns formed on the sheet Q may be identified by visual recognition by the user. In this case, coordinate information (e.g., a grid or scales) may be printed together with the test patterns. The user may input, into the MFP 1, positional coordinates of the intersection identified through the visual recognition using the coordinate information printed together with the test patterns. In this case, in S250, the controller 10 may calculate the conveyance distance error of the sheet Q based on the positional coordinates of the intersection input via the user interface 90.

Alternatively, a position of an intersection between test patterns formed on a sheet Q may be calculated as a position of an intersection between approximate straight lines determined through linear approximation of the test patterns. In the aforementioned illustrative embodiment, a first test pattern and a second test pattern are formed on a sheet Q to intersect each other on the sheet Q. Nonetheless, the first test pattern and the second test pattern may be formed on the sheet Q so as to be in proximity to each other without intersecting each other on the sheet Q. Namely, the first test pattern and the second test pattern may be formed on the sheet Q in such a manner that the first test pattern and the second test pattern would interest each other in an imaginary intersection outside the sheet Q if the first test pattern and the second test pattern were extended beyond the sheet Q. Further, in other words, the first test pattern and the second test pattern may be formed on the sheet Q in such a manner that a virtual straight line or an approximate straight line for the first test pattern intersects a virtual straight line or an approximate straight line for the second test pattern within a specified area on the two-dimensional lattice that may include a printable area on the sheet Q and may extend beyond the sheet Q. In this regard, however, it is noted that the accuracy for calculating the conveyance distance error becomes lower as the imaginary intersection between the first test pattern and the second test pattern becomes farther away from the printable area on the sheet Q within which the first test pattern and the second test pattern are actually formed. Therefore, the first test pattern and the second test pattern are preferred to be formed so as to be as close to each other as possible even though the first test pattern and the second test pattern do not intersect each other on the sheet Q. Further, the aforementioned two-dimensional lattice having lattice points to place pixels is not limited to a two-dimensional lattice with an X-axis direction and a Y-axis direction orthogonal to each other. In other words, the two-dimensional lattice may be a two-dimensional lattice in which an X-axis direction is not orthogonal to a Y-axis direction perpendicular to each other.

In the aforementioned illustrative embodiment, aspects of the present disclosure are applied to the MFP 1 as an example of an image forming apparatus. Nonetheless, aspects of the present disclosure may be applied to an image forming system. In other words, in FIG. 1, the element 1, which is referred to as the MFP 1 in the aforementioned illustrative embodiment, may be configured as an image forming system 1. In this case, the image forming system 1 may include a separate printer 30, a separate scanner 70, and a controller 10 coupled with the printer 30 and the scanner 70. The printer 30 may be configured to form a first test pattern and a second test pattern on a sheet Q. The scanner 70 may be configured to scan the sheet Q with the first and second test patterns formed thereon, e.g., in an optical manner, and generate image data expressing a scanned image of the sheet Q. The controller 10 may be configured to control the printer 30 to form the first and second test patterns on the sheet Q, control the scanner 70 to scan the sheet Q, and identify a position of an intersection between the first and second test patterns formed on the sheet Q by analyzing the image data expressing the scanned image of the sheet Q scanned by the scanner 70. Further, the controller 10 may be configured to correct a control parameter for controlling the sheet conveyor 61 to convey sheets Q so as to suppress a conveyance distance error caused when the sheet conveyor 61 conveys the sheets Q, based on the identified position of the intersection between the first and second test patterns.

Hereinafter, a further modification according to aspects of the present disclosure will be described with reference to FIGS. 14, 15A, 15B, and 16A to 16D. In the following modification, elements having substantially the same configurations as exemplified in the aforementioned illustrative embodiment will be provided with the same reference numerals as used for the corresponding elements in the illustrative embodiment. Further, detailed explanations of those elements will be omitted.

In the aforementioned illustrative embodiment, as exemplified in FIGS. 2, 3, and 4A to 4D, the controller 10 controls the recording head 40 to form the first test pattern TP11 on a portion of the sheet Q that is positioned in the first recording area R1, using the first nozzle group N1, and form the second test pattern TP21 on a portion of the sheet Q that is positioned in the second recording area R2, using the second nozzle group N2. Nonetheless, the group N0 of ink discharge nozzles arranged in the sub scanning direction may include three or more nozzle groups for forming test patterns. For instance, in the present modification, as shown in FIG. 14, the group N0 of ink discharge nozzles includes a first nozzle group NG1, a second nozzle group NG2, a third nozzle group NG3, and a fourth nozzle group NG4. In other words, in the present modification, the controller 10 controls the recording head 40 to form a first test pattern TP10 on a portion of the sheet Q that is positioned in a first recording area RA1, using the first nozzle group NG1, form a second test pattern TP20 on a portion of the sheet Q that is positioned in a second recording area RA2, using the second nozzle group NG2, form a third test pattern TP30 on a portion of the sheet Q that is positioned in a third recording area RA3, using the third nozzle group NG3, and form a fourth test pattern TP40 on a portion of the sheet Q that is positioned in a fourth recording area RA4, using the fourth nozzle group NG4.

In the present modification, when receiving an instruction to print test patterns via the user interface 90 or from the external device 3, the controller 10 performs a test printing process shown in FIGS. 15A and 15B in accordance with one or more programs 13*a* stored in the ROM 13. For instance, when a user of the MFP 1 or an operator of the manufacturer of the MFP 1 operates the user interface 90 or the external device 3, the instruction to print test patterns is issued.

When the test printing process is started, the controller 10 activates and controls the printing unit driver 30 to, while controlling the PF motor 63, cause the sheet conveyor 61 to convey a sheet Q to an upstream end section of the recording area R0 below the recording head 40 in the sheet conveyance direction (S310: Cueing).

Afterward, the controller 10 performs a first pattern forming process (S320). In the first pattern forming process, the controller 10 controls, via the printing unit driver 30, the recording head 40 to form a first test pattern TP10 on a portion of the sheet Q that is positioned in the first recording area RA1, using the first nozzle group NG1 (S320). The first recording area RA1 corresponds to a partial area of the recording area R0 that is positioned under the first nozzle group NG1. In other words, the first recording area RA1 is an area of the recording area R0 where the recording head 40 is allowed to perform image formation using the first nozzle group NG1. The first nozzle group NG1 corresponds to a group of nozzles included in the nozzle group N0 that are positioned upstream of the other nozzles included in the nozzle group N0 in the sheet conveyance direction.

Figure 16A:
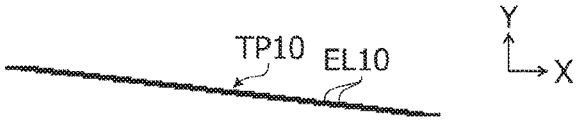

The first test pattern TP10 formed on the sheet Q has a geometrical pattern as exemplified in FIG. 16A. Specifically, the first test pattern TP10 is macroscopically or approximately a straight line that is slightly inclined relative to the main scanning direction. The first test pattern TP10 of the present modification may be the same geometrical pattern as one of the test patterns exemplified in the aforementioned illustrative embodiment. For instance, the first test pattern TP10 may be the same as the first test pattern TP11 shown in FIG. 5. In this case, an elemental figure EL10 (see FIG. 16A) of the first test pattern TP10 may be identical to the elemental figure EL11 shown in FIG. 5.

After the first test pattern TP10 has been formed, the controller 10 controls, via the printing unit driver 30, the sheet conveyor 61 to rotate the conveyance roller 613 by a particular amount L2 thereby conveying the sheet Q over the particular amount L2 downstream in the sheet conveyance direction (S330). Thereafter, when making a negative determination in S340, the controller 10 again performs the first pattern forming process (S320) in which the recording head 40 is controlled to form another first test pattern TP10 on the sheet Q. The process of conveying the sheet Q over the particular amount L2 is carried out by controlling a rotational amount of the conveyance roller 613. Therefore, an actual sheet conveyance distance in S330 contains an error relative to the particular amount L2.

After S330, the controller 10 determines whether the first test pattern TP10 first formed on the sheet Q has reached the second recording area RA2 of the recording area R0 (S340). Hereinafter, the first test pattern TP10 first formed on the sheet Q may be simply referred to as a "head first test pattern TP10" or a "first-formed first test pattern TP10" to differentiate it from other first test patterns TP10 to be subsequently formed on the sheet Q. The second recording area RA2 is an area in which the second test pattern TP20 is formed, within the recording area R0. When determining that the head first test pattern TP10 has not reached the second recording area RA2 (S340: No), the controller 10 goes to S320. Namely, until the first-formed first test pattern TP10 reaches the second recording area RA2, the controller 10 repeatedly performs the processes of making the negative determination in S340 (S340: No), controlling the recording head 40 to form the first test pattern TP10 on the sheet Q (S320), and controlling the sheet conveyor 61 to convey the sheet Q over the particular amount L2 (S330). Meanwhile, when determining that the head first test pattern TP10 has reached the second recording area RA2 (S340: Yes), the controller 10 goes to S350. In this regard, however, as shown in FIG. 14, a length between an upstream end of the first recording area RA1 and an upstream end of the second recording area RA2 in the sub scanning direction may be equal to the particular amount L2. In this case, after the first test pattern TP10 has been first formed on the sheet Q in S320 (see FIG. 16A), when the sheet Q is conveyed over the particular amount L2 in S330, the first-formed first test pattern TP10 necessarily reaches the second recording area RA2. Thus, in this case, after S330, the controller 10 may go to S350 without making the determination in S340.

In S350, the controller 10 performs a first-and-second-patterns forming process. In the first-and-second-patterns forming process, the controller 10 controls, via the printing unit driver 30, the recording head 40 to form an additional first test pattern TP10 and a second test pattern TP20 on the sheet Q (S350). Specifically, in S350, the controller 10 controls the recording head 40 to form the first test pattern TP10 on a portion of the sheet Q that is positioned in the first recording area RA1, using the first nozzle group NG1, and form the second test pattern TP20 on a portion of the sheet Q that is positioned in the second recording area RA2, using the second nozzle group NG2 (see FIG. 16B). The second recording area RA2 corresponds to a partial area of the recording area R0 that is positioned under the second nozzle group NG2. In other words, the second recording area RA2 is an area of the recording area R0 where the recording head 40 is allowed to perform image formation using the second nozzle group NG2. Among the nozzle group N0, the second nozzle group NG2 is positioned downstream of the first nozzle group NG1 in the sheet conveyance direction.

Figure 16B:
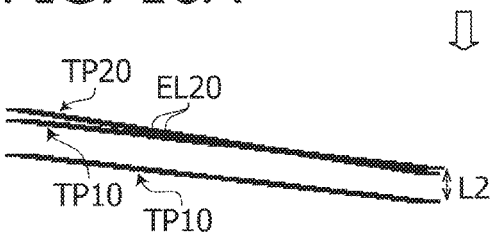

FIG. 16B exemplifies the second test pattern TP20 formed on the sheet Q. The second test pattern TP20 is macroscopically or approximately a straight line that is slightly inclined relative to the main scanning direction at a different degree of inclination from the first test pattern TP10. Namely, the second test pattern TP20 is macroscopically or approximately inclined relative to each of the main scanning direction and the first test pattern TP10. FIG. 16B shows a state where the second test pattern TP20 is formed in the first-executed S350 so as to intersect the head first test pattern TP10 (i.e., the first-formed first test patterns TP10) on the sheet Q. Further, as shown in FIG. 16B (as well as FIGS. 16C and 16D), the first test patterns TP10 are formed at intervals of the distance L2 (i.e., the particular amount L2) in the Y-axis direction.

The particular amount L2, which corresponds to the formation interval of the first test patterns TP10 in the Y-axis direction, is as long as a part of a recording area length divided by an integer. The recording area length is defined as a length between the upstream end of the first recording area RA1 and an upstream end of the fourth recording area RA4 in the sub scanning direction, within the recording area R0. Further, the particular amount L2 is as long as a part of the outer circumferential length of the conveyance roller 613 divided by an integer. The outer circumferential length of the conveyance roller 613 corresponds to a sheet conveyance distance when the conveyance roller has made a single rotation.

In the present modification, a conveyance distance error between the rotational amount of the conveyance roller 613 and the actual sheet conveyance distance depends on a rotational phase of the conveyance roller 613 in sheet conveyance. In the present modification, in order to suppress an influence of the above conveyance distance error depending on the rotational phase, a conveyance distance error is determined at each of different rotational phases that are defined by dividing the outer circumferential length of the conveyance roller 613 into a plurality of sections. The formation of the first test pattern TP10 at intervals of the particular amount L2 in the Y-axis direction is for determining a conveyance distance error at each rotational phase of the conveyance roller 613.

For instance, in the present modification, an elemental figure EL20 (see FIG. 16B) of the second test pattern TP20 may be identical to the elemental figure EL21 shown in FIG. 6. In this case, the second test pattern TP20 may have the same geometrical pattern as the second test pattern TP21 shown in FIG. 6.

After the second test pattern TP20 has been formed, the controller 10 controls, via the printing unit driver 30, the sheet conveyor 61 to convey the sheet Q over the particular amount L2 downstream in the sheet conveyance direction (S360). Thereafter, when making a negative determination in S370, the controller 10 again performs the first-and-second-patterns forming process (S350), in which the recording head 40 is controlled to form another first test pattern TP10 on the sheet Q with the first nozzle group NG1 and form another second test pattern TP20 with the second nozzle group NG2 to intersect the first test pattern TP10 that has reached the second recording area RA2.

After S360, the controller 10 determines whether the head first test pattern TP10 (i.e., the first-formed first test pattern TP10) has reached the third recording area RA3 of the recording area R0 (S370). The third recording area RA3 is an area in which the third test pattern TP30 is formed. It is noted that in S370, the controller 10 may determine whether the second-formed first test pattern TP10 has reached the second recording area RA2 of the recording area R0. When determining that the head first test pattern TP10 has not reached the third recording area RA3 (S370: No), the controller 10 goes to S350. Namely, until the first-formed first test pattern TP10 reaches the third recording area RA3, the controller 10 repeatedly performs the processes of making the negative determination in S370 (S370: No), controlling the recording head 40 to form the first test pattern TP10 and the second test pattern TP20 on the sheet Q (S350), and controlling the sheet conveyor 61 to convey the sheet Q over the particular amount L2 (S360). Meanwhile, when determining that the head first test pattern TP10 has reached the third recording area RA3 (S370: Yes), the controller 10 goes to S380. In this regard, however, as shown in FIG. 14, a length between the upstream end of the second recording area RA2 and an upstream end of the third recording area RA3 in the sub scanning direction may be equal to the particular amount L2. Namely, a length between the upstream end of the first recording area RA1 and the upstream end of the third recording area RA3 in the sub scanning direction may be twice as long as the particular amount L2. In this case, after the second test pattern TP20 has been first formed to intersect the first-formed first test pattern TP10 on the sheet Q in S350 (see FIG. 16B), when the sheet Q is conveyed over the particular amount L2 in S360, the first-formed first test pattern TP10 necessarily reaches the third recording area RA3. Thus, in this case, after S360, the controller 10 may go to S380 without making the determination in S370.

In S380, the controller 10 performs a first-to-third-patterns forming process. In the first-to-third-patterns forming process, the controller 10 controls, via the printing unit driver 30, the recording head 40 to form an additional first test pattern TP10, an additional second test pattern TP20, and a third test pattern TP30 on the sheet Q (S380). Specifically, in S380, the controller 10 controls the recording head 40 to form the first test pattern TP10 on a portion of the sheet Q that is positioned in the first recording area RA1, using the first nozzle group NG1. Concurrently, in S380, the controller 10 controls the recording head 40 to form the second test pattern TP20 on a portion of the sheet Q that is positioned in the second recording area RA2, using the second nozzle group NG2, in such a manner that the second test pattern TP20 intersects the first test pattern TP10 that has reached the second recording area RA2. Furthermore, in S380, the controller 10 controls the recording head 40 to form the third test pattern TP30 on a portion of the sheet Q that is positioned in the third recording area RA3, using the third nozzle group NG3 (see FIG. 16C). The third recording area RA3 corresponds to a partial area of the recording area R0 that is positioned under the third nozzle group NG3. In other words, the third recording area RA3 is an area of the recording area R0 where the recording head 40 is allowed to perform image formation using the third nozzle group NG3. Among the nozzle group N0, the third nozzle group NG3 is positioned downstream of the second nozzle group NG2 in the sheet conveyance direction.

Figure 16C:
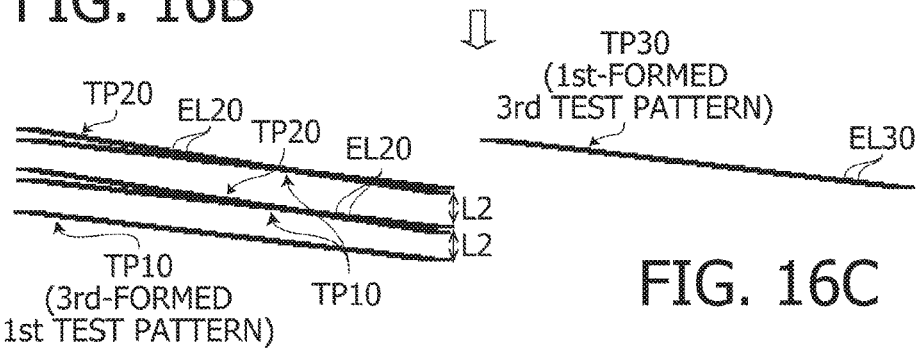

FIG. 16C exemplifies the third test pattern TP30 formed on the sheet Q. The third test pattern TP30 is macroscopically or approximately a straight line that is slightly inclined relative to the main scanning direction. FIG. 16C shows a state where the third test pattern TP30 is formed in the first-executed S380 so as not to intersect the first test patterns TP10 or the second test patterns TP20 (i.e., so as to be spaced apart from the first test patterns TP10 and the second test patterns TP20 in the main scanning direction).

For instance, in the present modification, an elemental figure EL30 (see FIG. 16C) of the third test pattern TP30 may be identical to the elemental figure EL11 shown in FIG. 5. In this case, the third test pattern TP30 may have the same geometrical pattern as the first test pattern TP11 shown in FIG. 5. Namely, in the present modification, the third test pattern TP30 may have the same geometrical pattern as the first test pattern TP10.

After the third test pattern TP30 has been formed, the controller 10 controls, via the printing unit driver 30, the sheet conveyor 61 to convey the sheet Q over the particular amount L2 downstream in the sheet conveyance direction (S390). Thereafter, when making a negative determination in S400, the controller 10 again performs the first-to-third-patterns forming process (S380), in which the recording head 40 is controlled to form another first test pattern TP10 on the sheet Q with the first nozzle group NG1, form another second test pattern TP20 with the second nozzle group NG2 to intersect the first test pattern TP10 that has reached the second recording area RA2, and form another third test pattern TP30 with the third nozzle group NG3 to be spaced apart from the first test patterns TP10 and the second test patterns TP20 in the main scanning direction.

After S390, the controller 10 determines whether the third test pattern TP30 first formed on the sheet Q has reached the fourth recording area RA4 of the recording area R0 (S400). Hereinafter, the third test pattern TP30 first formed on the sheet Q may be simply referred to as a "head third test pattern TP30" or a "first-formed third test pattern TP30" to differentiate it from other third test patterns TP30 to be subsequently formed on the sheet Q. The fourth recording area RA4 is an area in which the fourth test pattern TP40 is formed. It is noted that in S400, the controller 10 may determine whether the head first test pattern TP10 has reached the fourth recording area RA4 of the recording area R0. Alternatively, the controller 10 may determine in S400 whether the third-formed first test pattern TP10 has reached the second recording area RA2 of the recording area R0. When determining that the head third test pattern TP30 has not reached the fourth recording area RA4 (S400: No), the controller 10 goes to S380. Namely, until the first-formed third test pattern TP30 reaches the fourth recording area RA4, the controller 10 repeatedly performs the processes of making the negative determination in S370 (S400: No), controlling the recording head 40 to form the first test pattern TP10, the second test pattern TP20, and the third test pattern TP30 on the sheet Q (S380), and controlling the sheet conveyor 61 to convey the sheet Q over the particular amount L2 (S390). Meanwhile, when determining that the head third test pattern TP30 has reached the fourth recording area RA4 (S400: Yes), the controller 10 goes to S410. In this regard, however, as shown in FIG. 14, a length between the upstream end of the third recording area RA3 and the upstream end of the fourth recording area RA4 in the sub scanning direction may be equal to the particular amount L2. In this case, after the third test pattern TP30 has been first formed on the sheet Q in S380 (see FIG. 16C), when the sheet Q is conveyed over the particular amount L2 in S390, the first-formed third test pattern TP30 necessarily reaches the fourth recording area RA4. Thus, in this case, after S390, the controller 10 may go to S410 without making the determination in S400.

In S410, the controller 10 performs a first-to-fourth-patterns forming process. In the first-to-fourth-patterns forming process, the controller 10 controls, via the printing unit driver 30, the recording head 40 to form an additional first test pattern TP10, an additional second test pattern TP20, an additional third test pattern TP30, and a fourth test pattern TP40 on the sheet Q (S410). Specifically, in S410, the controller 10 controls the recording head 40 to form the first test pattern TP10 on a portion of the sheet Q that is positioned in the first recording area RAL using the first nozzle group NG1. Concurrently, in S410, the controller 10 controls the recording head 40 to form the second test pattern TP20 on a portion of the sheet Q that is positioned in the second recording area RA2, using the second nozzle group NG2, in such a manner that the second test pattern TP20 intersects the first test pattern TP10 that has reached the second recording area RA2. Furthermore, in S410, the controller 10 controls the recording head 40 to form the third test pattern TP30 on a portion of the sheet Q that is positioned in the third recording area RA3, using the third nozzle group NG3. Moreover, in S410, the controller 10 controls the recording head 40 to form the fourth test pattern TP40 on a portion of the sheet Q that is positioned in the fourth recording area RA4, using the fourth nozzle group NG4, in such a manner that the fourth test pattern TP40 intersects the third test pattern TP30 that has reached the fourth recording area RA4 (see FIG. 16D). The fourth recording area RA4 corresponds to a partial area of the recording area R0 that is positioned under the fourth nozzle group NG4. In other words, the fourth recording area RA4 is an area of the recording area R0 where the recording head 40 is allowed to perform image formation using the fourth nozzle group NG4. Among the nozzle group N0, the fourth nozzle group NG4 is positioned downstream of the third nozzle group NG3 in the sheet conveyance direction.

Figure 16D:
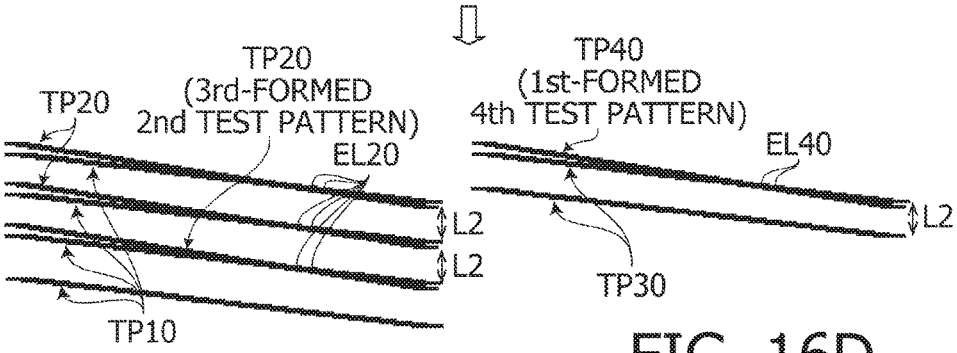

FIG. 16D exemplifies the fourth test pattern TP40 formed on the sheet Q. The fourth test pattern TP40 is macroscopically or approximately a straight line that is slightly inclined relative to the main scanning direction at a different degree of inclination from the third test pattern TP30. Namely, the fourth test pattern TP40 is macroscopically or approximately inclined relative to each of the main scanning direction and the third test pattern TP30. FIG. 16D shows a state where the fourth test pattern TP40 is formed in the first-executed S410 so as to intersect the head third test pattern TP30 (i.e., the first-formed third test patterns TP30) on the sheet Q.

For instance, in the present modification, an elemental figure EL40 (see FIG. 16D) of the fourth test pattern TP40 may be identical to the elemental figure EL21 shown in FIG. 6. In this case, the fourth test pattern TP40 may have the same geometrical pattern as the second test pattern TP21 shown in FIG. 6. Namely, in the present modification, the fourth test pattern TP40 may have the same geometrical pattern as the second test pattern TP20.

After the fourth test pattern TP40 has been formed, the controller 10 controls, via the printing unit driver 30, the sheet conveyor 61 to convey the sheet Q over the particular amount L2 downstream in the sheet conveyance direction (S420). Thereafter, when making a negative determination in S430, the controller 10 again performs the first-to-fourth-patterns forming process (S410), in which the recording head 40 is controlled to form another first test pattern TP10 on the sheet Q with the first nozzle group NG1, form another second test pattern TP20 with the second nozzle group NG2 to intersect the first test pattern TP10 that has reached the second recording area RA2, form another third test pattern TP30 with the third nozzle group NG3, and form another fourth test pattern TP40 with the fourth nozzle group NG4 to intersect the third test pattern TP30 that has reached the fourth recording area RA4.

After S420, the controller 10 determines whether a predetermined number of first test patterns TP10 have been completely formed (S430). When determining that the predetermined number of first test patterns TP10 have not been completely formed (S430: No), the controller 10 goes to S410. Namely, until the predetermined number of first test patterns TP10 are completely formed, the controller 10 repeatedly performs the processes of making the negative determination in S430 (S430: No), controlling the recording head 40 to form the first test pattern TP10, the second test pattern TP20, the third test pattern TP30, and the fourth test pattern TP40 on the sheet Q (S410), and controlling the sheet conveyor 61 to convey the sheet Q over the particular amount L2 (S420).

Meanwhile, when determining that the predetermined number of first test patterns TP10 have been completely formed (S430: Yes), the controller 10 goes to S440. In this regard, however, according to aspects of the present disclosure, the controller 10 may stop forming the first test patterns TP10 at a point of time when the fourth test pattern TP40 has been first formed on the sheet Q in S410 (see FIG. 16D). In this case, after S420, the controller 10 may go to S440 without making the determination in S430.

In S440, the controller 10 performs a second-to-fourth-patterns forming process. In the second-to-fourth-patterns forming process, the controller 10 controls, via the printing unit driver 30, the recording head 40 to form an additional second test pattern TP20, an additional third test pattern TP30, and an additional fourth test pattern TP40 on the sheet Q (S440). Specifically, in S440, the controller 10 controls the recording head 40 to form the second test pattern TP20 on a portion of the sheet Q that is positioned in the second recording area RA2, using the second nozzle group NG2, in such a manner that the second test pattern TP20 intersects the first test pattern TP10 that has reached the second recording area RA2. Furthermore, in S440, the controller 10 controls the recording head 40 to form the third test pattern TP30 on a portion of the sheet Q that is positioned in the third recording area RA3, using the third nozzle group NG3. Moreover, in S440, the controller 10 controls the recording head 40 to form the fourth test pattern TP40 on a portion of the sheet Q that is positioned in the fourth recording area RA4, using the fourth nozzle group NG4, in such a manner that the fourth test pattern TP40 intersects the third test pattern TP30 that has reached the fourth recording area RA4.

After S440, the controller 10 controls, via the printing unit driver 30, the sheet conveyor 61 to convey the sheet Q over the particular amount L2 downstream in the sheet conveyance direction (S450). Thereafter, when making a negative determination in S460, the controller 10 again performs the second-to-fourth-patterns forming process (S440), in which the recording head 40 is controlled to form another second test pattern TP20 with the second nozzle group NG2 to intersect the first test pattern TP10 that has reached the second recording area RA2, form another third test pattern TP30 with the third nozzle group NG3, and form another fourth test pattern TP40 with the fourth nozzle group NG4 to intersect the third test pattern TP30 that has reached the fourth recording area RA4.

After S450, the controller 10 determines whether the second test pattern TP20 has been formed for each of all the first test patterns TP10 (S460). When determining that the second test pattern TP20 has not been formed for each of all the first test patterns TP10 (S460: No), the controller 10 goes to S440. Namely, until the second test pattern TP20 is formed for each of all the first test patterns TP10, the controller 10 repeatedly performs the processes of making the negative determination in S460 (S460: No), controlling the recording head 40 to form the second test pattern TP20, the third test pattern TP30, and the fourth test pattern TP40 on the sheet Q (S440), and controlling the sheet conveyor 61 to convey the sheet Q over the particular amount L2 (S450).

Meanwhile, when determining that the second test pattern TP20 has been formed for each of all the first test patterns TP10 (S460: Yes), the controller 10 goes to S470. In S470, the controller 10 performs a third-and-fourth-patterns forming process.

In the third-and-fourth-patterns forming process, the controller 10 controls, via the printing unit driver 30, the recording head 40 to form an additional third test pattern TP30 and an additional fourth test pattern TP40 on the sheet Q (S470). Specifically, in S470, the controller 10 controls the recording head 40 to form the third test pattern TP30 on a portion of the sheet Q that is positioned in the third recording area RA3, using the third nozzle group NG3. Further, in S470, the controller 10 controls the recording head 40 to form the fourth test pattern TP40 on a portion of the sheet Q that is positioned in the fourth recording area RA4, using the fourth nozzle group NG4, in such a manner that the fourth test pattern TP40 intersects the third test pattern TP30 that has reached the fourth recording area RA4.

After S470, the controller 10 controls, via the printing unit driver 30, the sheet conveyor 61 to convey the sheet Q over the particular amount L2 downstream in the sheet conveyance direction (S480). Thereafter, when making a negative determination in S490, the controller 10 again performs the third-and-fourth-patterns forming process (S470), in which the recording head 40 is controlled to form another third test pattern TP30 with the third nozzle group NG3, and form another fourth test pattern TP40 with the fourth nozzle group NG4 to intersect the third test pattern TP30 that has reached the fourth recording area RA4.

After S480, the controller 10 determines whether a predetermined number of third test patterns TP30 have been completely formed (S490). When determining that the predetermined number of third test patterns TP30 have not been completely formed (S490: No), the controller 10 goes to S470. Namely, until the predetermined number of third test patterns TP30 are completely formed, the controller 10 repeatedly performs the processes of making the negative determination in S490 (S490: No), controlling the recording head 40 to form the third test pattern TP30 and the fourth test pattern TP40 on the sheet Q (S470), and controlling the sheet conveyor 61 to convey the sheet Q over the particular amount L2 (S480).

Meanwhile, when determining that the predetermined number of third test patterns TP30 have been completely formed (S490: Yes), the controller 10 goes to S500. In this regard, however, according to aspects of the present disclosure, the controller 10 may stop forming the third test patterns TP30 at a point of time when the fourth test pattern TP40 has been formed on the sheet Q in S470. In this case, after S480, the controller 10 may go to S500 without making the determination in S490.

In S500, the controller 10 performs a fourth pattern forming process. In the fourth pattern forming process, the controller 10 controls, via the printing unit driver 30, the recording head 40 to form an additional fourth test pattern TP40 on the sheet Q (S500). Specifically, in S500, the controller 10 controls the recording head 40 to form the fourth test pattern TP40 on a portion of the sheet Q that is positioned in the fourth recording area RA4, using the fourth nozzle group NG4, in such a manner that the fourth test pattern TP40 intersects the third test pattern TP30 that has reached the fourth recording area RA4.

Afterward, the controller 10 determines whether the fourth test pattern TP40 has been formed for each of all the third test patterns TP30 (S510). When determining that the fourth test pattern TP40 has not been formed for each of all the third test patterns TP30 (S510: No), the controller 10 goes to S520. Meanwhile, when determining that the fourth test pattern TP40 has been formed for each of all the third test patterns TP30 (S510: Yes), the controller 10 goes to S530.

In S520, the controller 10 controls the sheet conveyor 61 to convey the sheet Q over the particular amount L2. Thereafter, the controller 10 goes to S500. Thus, until the fourth test pattern TP40 is formed for each of all the third test patterns TP30, the controller 10 repeatedly performs the processes of making the negative determination in S510 (S510: No), controlling the sheet conveyor 61 to convey the sheet Q over the particular amount L2 (S520), and controlling the recording head 40 to form the fourth test pattern TP40 on the sheet Q (S500). Then, when the fourth test pattern TP40 has been formed for each of all the third test patterns TP30 (S510: Yes), the controller 10 goes to S530.

In S530, the controller 10 performs a sheet discharging process. In the sheet discharging process, the controller 10 controls, via the printing unit driver 30, the sheet conveyor 61 to convey and discharge the sheet Q onto the discharge tray (not shown). Further, the controller 10 controls the user interface 90 to display, on the display of the user interface 90, a message that prompts the user to place the sheet Q with the test patterns printed thereon on the document table of the scanning unit 70 and input a scanning instruction (S540). Thereafter, the controller 10 waits until a scanning instruction is input through the user interface 90 (S550).

When a scanning instruction has been input, the controller 10 performs a scanning process (S560). Specifically, in S560, the controller 10 controls the scanning unit 70 to scan the sheet Q with the test patterns printed thereon, and acquires image data expressing the scanned image from the scanning unit 70.

Further, the controller 10 calculates a positional displacement, from a reference point, of an intersection between each first test pattern TP10 and the corresponding second test pattern TP20 based on the image data acquired from the scanning unit 70. The controller 10 also calculates a positional displacement, from a reference point, of an intersection between each third test pattern TP30 and the corresponding fourth test pattern TP40 based on the acquired image data. Then, the controller 10 calculates a conveyance distance error of the sheet Q based on the calculated positional displacements (S570). Based on the conveyance distance error calculated in S570, the controller 10 updates the particular control parameter (included in the control parameters stored in the NVRAM 17) that represents the association between the rotational quantity of the conveyance roller 613 and the sheet conveyance distance (S580). Thereafter, the controller 10 terminates the test printing process shown in FIGS. 15A and 15B.

Further, according to the present modification, it is possible to determine whether the conveyance distance error calculated in S570 contains an unacceptable amount of error caused by the scanning process. It is noted that, in the present modification, a sheet scanning direction for scanning the sheet Q in the scanning process (see S560) is the same as the main scanning direction. Namely, in the present modification, as shown in FIG. 16D, the intersections between the first test patterns TP10 and the second test patterns TP20 are positionally different from the intersections between the third test patterns TP30 and the fourth test patterns TP40 in the sheet scanning direction. For instance, as shown in FIG. 16C, the third-formed first test pattern TP10 and the first-formed third test pattern TP30 are written in the same step, i.e., the first-executed S380. Further, as shown in FIG. 16D, the third-formed second test pattern TP20 that intersects the third-formed first test pattern TP10 and the first-formed fourth test pattern TP40 that intersects the first-formed third test pattern TP30 are written in the same step, i.e., the first-executed S410. Namely, if the conveyance distance error calculated in S570 merely contains a negligibly small amount of error caused by the scanning process, a first conveyance distance error calculated based on the intersection between the third-formed first test pattern TP10 and the third-formed second test pattern TP20 should be substantially identical to a second conveyance distance error calculated based on the intersection between the first-formed third test pattern TP30 and the first-formed fourth test pattern TP40. Accordingly, by comparing the first conveyance distance error and the second conveyance distance error, it is possible to determine whether the conveyance distance error calculated in S570 contains an unacceptable amount of error caused by the scanning process. For example, when there is not a significant difference between the first conveyance distance error and the second conveyance distance error, it may be possible to determine that the conveyance distance error calculated in S570 does not contain an unacceptable amount of error caused by the scanning process.

Alternatively, the first conveyance distance error and the second conveyance distance error may be compared with a threshold value. In this case, when one of the first conveyance distance error and the second conveyance distance error is more than the threshold value, the error more than the threshold value may be regarded as an abnormal or invalid value, and may not be used for determining a final conveyance distance error in S570.

In the present modification, as shown in FIGS. 16C and 16D, the third test patterns TP30 and the fourth test patterns TP40 are formed to be spaced apart from the first test patterns TP10 and the second test patterns TP20 in the main scanning direction. Nonetheless, the third test patterns TP30 and the fourth test patterns TP40 may not necessarily be formed to be spaced apart from the first test patterns TP10 and the second test patterns TP20 in the main scanning direction, as long as each test pattern and each intersection between two test patterns can be read in a discriminable manner in the scanning process.

A function of a single element in the aforementioned illustrative embodiment and modifications may be dispersedly provided to a plurality of elements. Functions of a plurality of elements may be integrally provided to a single element. Some of elements constituting the aforementioned illustrative embodiment and modifications may be omitted. At least a part of elements constituting the aforementioned illustrative embodiment and modifications may be added to or replaced with elements in another modification according to aspects of the present disclosure.

In the aforementioned illustrative embodiment, the first nozzle group N1 of the recording head 40 may be an example of the "first image former" according to aspects of the present disclosure. The second nozzle group N2 of the recording head 40 may be an example of the "second image former" according to aspects of the present disclosure. The controller 10 may be an example of the "controller" according to aspects of the present disclosure. A combination of the controller 10 and the printing unit driver 30 may also be an example of the "controller" according to aspects of the present disclosure. The processes in S120 and S150 may be examples of the "first formation control process" according to aspects of the present disclosure. The processes in S130, S160, S200, and S210 may be examples of the "conveyance control process" according to aspects of the present disclosure. The processes in S150 and S180 may be examples of the "second formation control process" according to aspects of the present disclosure. The process in S240 may be an example of the "scanning control process" according to aspects of the present disclosure. The process in S250 may be an example of the "error determining process" according to aspects of the present disclosure.

In the modification exemplified in FIG. 12, the upstream line inkjet heads 141, 142, and 143 may be examples of the "first image former" according to aspects of the present disclosure. The downstream line inkjet heads 142, 143, and 144 may be examples of the "second image former" according to aspects of the present disclosure.

When aspects of the present disclosure are applied to a laser printer having a plurality of photoconductive bodies arranged in a conveyance direction of a sheet Q or a transfer belt, upstream two of the plurality of photoconductive bodies in the conveyance direction may be examples of the "first image former" according to aspects of the present disclosure. Downstream two of the plurality of photoconductive bodies in the conveyance direction may be examples of the "second image former" according to aspects of the present disclosure.

In the further modification exemplified in FIGS. 14, 15A, 15B, and 16A-16D, the first nozzle group NG1 and the third nozzle group NG3 may be examples of the "first image former" according to aspects of the present disclosure. The second nozzle group NG2 and the fourth nozzle group NG4 may be examples of the "second image former" according to aspects of the present disclosure. The processes in S320, S350, S380, S410, S440, and S470 may be examples of the "first formation control process" according to aspects of the present disclosure. The processes in S330, S360, S390, S420, S450, S480, S520, and S530 may be examples of the "conveyance control process" according to aspects of the present disclosure. The processes in S350, S380, S410, S440, S470, and S500 may be examples of the "second formation control process" according to aspects of the present disclosure. The process in S560 may be an example of the "scanning control process" according to aspects of the present disclosure. The process in S570 may be an example of an "error determining process" according to aspects of the present disclosure.

What is claimed is:

1. An image forming apparatus comprising:

a conveyor configured to convey a recording medium in a conveyance direction;

a first image former configured to form an image on the recording medium by selectively placing pixels on lattice points of a two-dimensional lattice, the two-dimensional lattice including a plurality of lattice points arranged at intervals of a predetermined pitch in each of an X-axis direction and a Y-axis direction, the Y-axis direction being parallel to the conveyance direction, the X-axis direction intersecting the Y-axis direction;

a second image former disposed downstream of the first image former in the conveyance direction, the second image former being configured to form an image on the recording medium by selectively placing pixels on lattice points of the two-dimensional lattice; and a controller configured to perform:

a first formation control process comprising:

controlling the first image former to form a first test pattern on the recording medium, wherein the first test pattern comprises a plurality of figures arranged on a first virtual straight line extending in a first direction, the first direction is inclined relative to the X-axis direction and is directed from a first arbitrary lattice point toward a first specific lattice point on the two-dimensional lattice, the first specific lattice point is an A1-th lattice point from the first arbitrary lattice point as a zeroth lattice point in the X-axis direction and is a B1-th lattice point from the first arbitrary lattice point as a zeroth lattice point in the Y-axis direction, and B1 is a value smaller than A1;

a conveyance control process comprising:

controlling the conveyor to convey the recording medium downstream in the conveyance direction; and a second formation control process comprising:

in response to the recording medium being conveyed to a position where a second test pattern to be formed is allowed to intersect or be in proximity to the first test pattern formed on the recording medium, controlling the second image former to form the second test pattern on the recording medium, wherein the second test pattern comprises a plurality of figures arranged on a second virtual straight line extending in a second direction, the second direction is inclined relative to each of the X-axis direction and the first direction and is directed from a second arbitrary lattice point toward a second specific lattice point on the two-dimensional lattice, the second specific lattice point is an A2-th lattice point from the second arbitrary lattice point as a zeroth lattice point in the X-axis direction and is a B2-th lattice point from the second arbitrary lattice point as a zeroth lattice point in the Y-axis direction, and B2 is a value smaller than A2.

2. The image forming apparatus according to claim 1, wherein the first test pattern comprises a plurality of first elemental figures arranged on the first virtual straight line extending in the first direction, and wherein the second test pattern comprises a plurality of second elemental figures arranged on the second virtual straight line extending in the second direction.

3. The image forming apparatus according to claim 2, wherein each first elemental figure included in the first test pattern is a pixel cluster comprising a plurality of pixels arranged linearly or in a rectangular shape, the pixel cluster having a constant count of pixels in each of the X-axis direction and the Y-axis direction, and wherein each second elemental figure included in the second test pattern is a pixel cluster comprising a plurality of pixels arranged linearly or in a rectangular shape, each pixel cluster having a constant count of pixels in the X-axis direction and having a constant count of pixels in the Y-axis direction.

4. The image forming apparatus according to claim 2, wherein the first elemental figure is a pixel cluster comprising a plurality of pixels, a count of the pixels in the X-axis being an integral multiple of A1, a count of the pixels in the Y-axis being equal to B1, and wherein the second elemental figure is a pixel cluster comprising a plurality of pixels, a count of the pixels in the X-axis being an integral multiple of A2, a count of the pixels in the Y-axis being equal to B2.

5. The image forming apparatus according to claim 1, wherein the first test pattern comprises a plurality of pixel rows arranged on the first virtual straight line extending in the first direction, each pixel row comprising a plurality of pixels arranged in the X-axis direction, and wherein the second test pattern comprises a plurality of pixel rows arranged on the second virtual straight line extending in the second direction, each pixel row comprising a plurality of pixels arranged in the X-axis direction.

6. The image forming apparatus according to claim 1, wherein each of B1 and B2 is a value equal to one, and wherein A1 and A2 are mutually different integer values more than one.

7. The image forming apparatus according to claim 1, wherein the controller is further configured to:

repeatedly perform the first formation control process each time the recording medium is conveyed over a particular distance, the particular distance being less than a distance over which the recording medium is conveyed to a position where the second test pattern to be first formed is allowed to intersect or be in proximity to a first-formed first test pattern of the first test patterns formed on the recording medium; and repeatedly perform the second formation control process each time the recording medium reaches a position where the second test pattern to be next formed is allowed to intersect or be in proximity to a corresponding one of the first test patterns formed on the recording medium.

8. The image forming apparatus according to claim 1, further comprising a scanner configured to optically scan the recording medium with the first test pattern and the second test pattern formed thereon, wherein the controller is further configured to identify a position of an intersection between the first test pattern and the second test pattern formed on the recording medium by analyzing image data expressing a scanned image of the recording medium scanned by the scanner.

9. The image forming apparatus according to claim 1, wherein the controller is further configured to correct a control parameter for the conveyance control process to suppress a conveyance distance error caused by conveyance of the recording medium, based on an intersection between the first test pattern and the second test pattern formed on the recording medium.

10. The image forming apparatus according to claim 1, further comprising an inkjet head comprising a plurality of nozzles arranged in the conveyance direction, the inkjet head being configured to discharge ink droplets from the plurality of nozzles while moving relative to the recording medium in a direction intersecting the conveyance direction, wherein the first image former comprises a first group of nozzles included in the plurality of nozzles, and wherein the second image former comprises a second group of nozzles included in the plurality of nozzles, the second group of nozzles being positioned downstream of the first group of nozzles in the conveyance direction.

11. The image forming apparatus according to claim 1, further comprising a plurality of inkjet heads each of which comprises a plurality of nozzles arranged in a direction intersecting the conveyance direction, each inkjet head being configured to discharge ink droplets from the plurality of nozzles onto the recording medium that is relatively moving in the conveyance direction, wherein the first image former comprises a first inkjet head of the plurality of inkjet heads, and wherein the second image former comprises a second inkjet head of the plurality of inkjet heads, the second inkjet head being positioned downstream of the first inkjet head in the conveyance direction.

12. The image forming apparatus according to claim 1, wherein the second formation control process comprises:

in response to the recording medium being conveyed to a position where the second virtual straight line for the second test pattern is allowed to intersect the first virtual straight line for the first test pattern within a specified area on the two-dimensional lattice, controlling the second image former to form the second test pattern on the recording medium, the specified area including a printable area on the recording medium.

13. The image forming apparatus according to claim 12, wherein the specified area extends beyond the printable area on the recording medium.

14. The image forming apparatus according to claim 1, wherein the second formation control process comprises:

in response to the recording medium being conveyed to a position where an approximate straight line for the second test pattern is allowed to intersect an approximate straight line for the first test pattern within a specified area on the two-dimensional lattice, controlling the second image former to form the second test pattern on the recording medium, the specified area including a printable area on the recording medium.

15. The image forming apparatus according to claim 14, wherein the specified area extends beyond the printable area on the recording medium.

16. The printer according to claim 1, wherein the controller comprises:

a processor; and a memory storing processor-executable instructions configured to, when executed by the processor, cause the processor to perform the first formation control process, the conveyance control process, and the second formation control process.

17. An image forming system comprising:

a printer configured to form a first test pattern and a second test pattern on a recording medium;

a scanner configured to scan the recording medium with the first test pattern and the second test pattern formed thereon, and generate image data expressing a scanned image of the recording medium; and a controller coupled with the printer and the scanner, wherein the printer comprises:

a conveyor configured to convey the recording medium in a conveyance direction;

a first image former configured to form an image on the recording medium by selectively placing pixels on lattice points of a two-dimensional lattice, the two-dimensional lattice including a plurality of lattice points arranged at intervals of a predetermined pitch in each of an X-axis direction and a Y-axis direction, the Y-axis direction being parallel to the conveyance direction, the X-axis direction intersecting the Y-axis direction; and a second image former disposed downstream of the first image former in the conveyance direction, the second image former being configured to form an image on the recording medium by selectively placing pixels on lattice points of the two-dimensional lattice, wherein the controller is configured to perform:

a first formation control process comprising:

controlling the first image former to form the first test pattern on the recording medium, wherein the first test pattern comprises a plurality of figures arranged on a first virtual straight line extending in a first direction, the first direction is inclined relative to the X-axis direction and is directed from a first arbitrary lattice point toward a first specific lattice point on the two-dimensional lattice, the first specific lattice point is an A1-th lattice point from the first arbitrary lattice point as a zeroth lattice point in the X-axis direction and is a B1-th lattice point from the first arbitrary lattice point as a zeroth lattice point in the Y-axis direction, and B1 is a value smaller than A1;

a conveyance control process comprising:

controlling the conveyor to convey the recording medium downstream in the conveyance direction;

a second formation control process comprising:

in response to the recording medium being conveyed to a position where the second test pattern to be formed is allowed to intersect or be in proximity to the first test pattern formed on the recording medium, controlling the second image former to form the second test pattern on the recording medium, wherein the second test pattern comprises a plurality of figures arranged on a second virtual straight line extending in a second direction, the second direction is inclined relative to each of the X-axis direction and the first direction and is directed from a second arbitrary lattice point toward a second specific lattice point on the two-dimensional lattice, the second specific lattice point is an A2-th lattice point from the second arbitrary lattice point as a zeroth lattice point in the X-axis direction and is a B2-th lattice point from the second arbitrary lattice point as a zeroth lattice point in the Y-axis direction, and B2 is a value smaller than A2;

a scanning control process comprising:

controlling the scanner to scan the recording medium with the first test pattern and the second test pattern formed thereon and to generate image data expressing a scanned image of the recording medium; and an error determining process comprising:

identifying a position of an intersection between the first test pattern and the second test pattern formed on the recording medium by analyzing the image data generated by the scanner; and determining a conveyance distance error caused by conveyance of the recording medium based on the identified position of the intersection between the first test pattern and the second test pattern.

18. The image forming apparatus according to claim 17, wherein the controller comprises:

a processor; and a memory storing processor-executable instructions configured to, when executed by the processor, cause the processor to perform the first formation control process, the conveyance control process, and the second formation control process.

19. A method implementable on a processor coupled with an image forming apparatus comprising:

a conveyor configured to convey a recording medium in a conveyance direction;

a first image former configured to form an image on the recording medium by selectively placing pixels on lattice points of a two-dimensional lattice, the two-dimensional lattice including a plurality of lattice points arranged at intervals of a predetermined pitch in each of an X-axis direction and a Y-axis direction, the Y-axis direction being parallel to the conveyance direction, the X-axis direction intersecting the Y-axis direction; and a second image former disposed downstream of the first image former in the conveyance direction, the second image former being configured to form an image on the recording medium by selectively placing pixels on lattice points of the two-dimensional lattice, the method comprising:

performing a first formation control process comprising:

controlling the first image former to form a first test pattern on the recording medium, wherein the first test pattern comprises a plurality of figures arranged on a first virtual straight line extending in a first direction, the first direction is inclined relative to the X-axis direction and is directed from a first arbitrary lattice point toward a first specific lattice point on the two-dimensional lattice, the first specific lattice point is an A1-th lattice point from the first arbitrary lattice point as a zeroth lattice point in the X-axis direction and is a B1-th lattice point from the first arbitrary lattice point as a zeroth lattice point in the Y-axis direction, and B1 is a value smaller than A1;

performing a conveyance control process comprising:

controlling the conveyor to convey the recording medium downstream in the conveyance direction; and performing a second formation control process comprising:

in response to the recording medium being conveyed to a position where a second test pattern is allowed to intersect or be in proximity to the first test pattern formed on the recording medium, controlling the second image former to form the second test pattern on the recording medium, wherein the second test pattern comprises a plurality of figures arranged on a second virtual straight line extending in a second direction, the second direction is inclined relative to each of the X-axis direction and the first direction and is directed from a second arbitrary lattice point toward a second specific lattice point on the two-dimensional lattice, the second specific lattice point is an A2-th lattice point from the second arbitrary lattice point as a zeroth lattice point in the X-axis direction and is a B2-th lattice point from the second arbitrary lattice point as a zeroth lattice point in the Y-axis direction, and B2 is a value smaller than A2.

* * * * *